US012173948B2

(12) United States Patent
Goh et al.

(10) Patent No.: US 12,173,948 B2
(45) Date of Patent: Dec. 24, 2024

(54) REFRIGERATOR

(71) Applicant: LG Electronics Inc., Seoul (KR)

(72) Inventors: Doohee Goh, Seoul (KR); Seongjin Na, Seoul (KR); Changwoan Yang, Seoul (KR); Jaekoo Kang, Seoul (KR); Yongrak Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 273 days.

(21) Appl. No.: 17/776,170

(22) PCT Filed: Nov. 13, 2020

(86) PCT No.: PCT/KR2020/016014
§ 371 (c)(1),
(2) Date: May 11, 2022

(87) PCT Pub. No.: WO2021/096301
PCT Pub. Date: May 20, 2021

(65) Prior Publication Data

US 2022/0397329 A1 Dec. 15, 2022

(30) Foreign Application Priority Data

Nov. 13, 2019 (KR) ..... 10-2019-0145457
Mar. 4, 2020 (KR) ..... 10-2020-0027420

(51) Int. Cl.
*F25D 11/00* (2006.01)
*F25D 23/06* (2006.01)

(52) U.S. Cl.
CPC ..... *F25D 11/00* (2013.01); *F25D 23/065* (2013.01)

(58) Field of Classification Search
CPC ..... F25D 23/065; F25D 11/00
See application file for complete search history.

(56) References Cited

U.S. PATENT DOCUMENTS

2008/0180010 A1 7/2008 Iguchi et al.

FOREIGN PATENT DOCUMENTS

| | | | | |
|---|---|---|---|---|
| EP | 3786553 | A1 | | 3/2021 |
| JP | H07159025 | A | * | 11/1993 |
| JP | H07159025 | | | 6/1995 |
| JP | H09145245 | | | 11/1995 |
| JP | 2000337752 | A | | 12/2000 |
| JP | 2010190473 | A | * | 9/2010 |
| KR | 101336592 | B1 | * | 9/2013 |

(Continued)

OTHER PUBLICATIONS

Okada, Cooling storage, 2009, Full Document (Year: 2009).*

(Continued)

*Primary Examiner* — Nael N Babaa
(74) *Attorney, Agent, or Firm* — Fish & Richardson P.C.

(57) ABSTRACT

A refrigerator includes a storage space defined in a cabinet and a machine room arranged under the storage space. To implement a cooling system, a compressor, a condenser, and a heat dissipation fan are included in the machine room. In addition, a control module is provided in the machine room to face an outlet of the machine room. The control module is installed at a position close to the entrance of the machine room and configured to be separated frontward from the machine room, and thus accessibility to the control module can be enhanced.

20 Claims, 22 Drawing Sheets

(56) References Cited

FOREIGN PATENT DOCUMENTS

| | | | |
|---|---|---|---|
| WO | WO 2017138427 | A1 | 8/2017 |
| WO | WO201942234 | A1 * | 8/2019 |

OTHER PUBLICATIONS

Tamura, Cooling storage box, 1993, Full Document (Year: 1993).*
Lee, Cold storage system, 2013, Full Document (Year: 2013).*
Lu, Order delivery method and apparatus thereof, 2018, Full Document (Year: 2017).*
Extended European Search Report in European Appln. No. 20888608.5, mailed on Feb. 29, 2024, 11 pages.
Partial Supplementary European Search Report in European Appln. No. 20888608.5, mailed on Oct. 23, 2023, 12 pages.

* cited by examiner

REFRIGERATOR

CROSS-REFERENCE TO RELATED APPLICATIONS

This application is a National Stage application under 35 U.S.C. § 371 of International Application No. PCT/KR2020/016014, filed on Nov. 13, 2020, which claims the benefit of Korean Patent Application No. 10-2019-0145457, filed on Nov. 13, 2019, and Korean Patent Application No. 10-2020-0027420, filed on Mar. 4, 2020. The disclosures of the prior applications are incorporated by reference in their entirety.

TECHNICAL FIELD

The present disclosure relates generally to a refrigerator. More particularly, the present disclosure relates to a refrigerator in which a control module is installed in a machine room.

BACKGROUND ART

Generally, a refrigerator is a home appliance which can store food at a low temperature in an internal storage space which is covered by a door. To this end, the refrigerator is configured to store food in an optimal state by cooling the inside of a storage space by using cold air generated through heat exchange with a refrigerant circulating in a refrigeration cycle.

Recently, a refrigerator is gradually becoming multifunctional according to changes in diet and the trend of product enhancement, and a refrigerator equipped with various structures and convenience devices for user convenience and efficient use of internal space has been released. Particularly, a refrigerator suitable for storage according to the type of alcoholic beverage due to the increase of consumption and preferences of alcoholic beverages such as wine and champagne, and a refrigerator for storing aged foods such as kimchi for a long time are being developed.

In addition, recently, the exterior of a refrigerator is designed to harmonize with furniture in the space for installing the refrigerator. For example, a built-in refrigerator is attracting attention in terms of interior design since an exposed part thereof is minimized. This serves to assist an existing refrigerator such that frequently used foods can be stored inside kitchen furniture, thereby improving the convenience of use.

Such a built-in refrigerator may be used even in a kitchen island, which has been widely applied recently, and island-type kitchen furniture, which is a workbench independent of a sink, has high convenience but has a low overall height, so the built-in type refrigerator is difficult to be applied to the island-type kitchen furniture.

Particularly, a refrigerator requires not only a storage space for storing food, but also a machine room for implementing a refrigeration cycle and a separate space for installing a control part for controlling the refrigerator, so it is difficult to miniaturize the refrigerator, and even if the refrigerator is miniaturized, the efficiency of refrigerator may decrease.

In order to solve these problems, it is possible to consider installing other devices as well as parts for implementing a refrigeration cycle inside the machine room. For example, the control part or a device for communication, together with the associated parts, may be installed in the machine room. In Korean Utility Model Application Publication No. 20-1999-0032472, the installation of a PCB on the side wall of the machine room of a refrigerator is disclosed, and in Korean Utility Model Registration No. 20-0256427, the installation of an electric box on the side wall of a machine room is disclosed.

However, according to these prior arts, by embedding the control part (a PCB, an electric box) in the machine room, the machine room of parts can be saved, but the control part is installed inside the machine room in which a compressor and a heat exchanger are installed, that is, at a position close to the rear of the refrigerator. Therefore, it is difficult to maintain the control part.

Particularly, a built-in refrigerator is often installed in a state in which a rear thereof is blocked, and thus when the control part is located at the inner side of the machine room close to the rear of the refrigerator, the entirety of the refrigerator is required to be first removed completely from built-in furniture for the maintenance of the control part.

In addition, the control part of the refrigerator according to the prior art is fixed to the side wall of the machine room by a separate fastener, and thus after the fastener is first removed and the control part is removed from the side wall, the control part may be repaired or replaced, so workability deteriorates.

Additionally, the control part of the prior art is installed in a direction standing on the side wall of the refrigerator, and thus to prevent the shaking of the control part, a circuit board constituting the control part is required to be fastened to a casing, and even when the control part is removed, the circuit board is not immediately exposed to the eye of an operator, so the maintenance of the control part is difficult.

DISCLOSURE

Technical Problem

The present disclosure has been made to solve the problems of the prior art as described above, and the present disclosure is intended to propose a refrigerator in which a control module for controlling the refrigerator is installed at a position close to the entrance of a machine room so as to be removed or installed in front of the refrigerator and does not prevent the introduction or discharge of air.

The present disclosure is further intended to propose a refrigerator in which the control module is slidably received in the machine room without a separate fastener.

The present disclosure is still further intended to propose a refrigerator in which the control module can be received in the machine room while in a lying state.

The present disclosure is still further intended to propose a refrigerator in which the arrangement and connection of electric wires in a cabinet are facilitated.

Technical Solution

In order to accomplish the above objectives, according to an aspect of the present disclosure, in a refrigerator of the present disclosure, a storage space may be defined in a cabinet, and a machine room may be provided under the storage space. The machine room may include a compressor, a condenser, and a heat dissipation fan for implementing a cooling system. Furthermore, in the machine room, a control module may be disposed to face an outlet of the machine room. The control module may be installed at a position close to an entrance of the machine room and may be removed forward from the machine room, so accessibility to the control module may be enhanced.

In addition, a front cover in which an inlet and the outlet are formed may be provided in the front surface of the machine room, and the control module may be installed to face the front cover. Accordingly, an operator may access the control module as soon as the front cover is removed from the refrigerator.

Furthermore, the open upper surface of the machine room may be covered by a cover plate, and the control module may be mounted to the lower surface of the cover plate, and may be spaced apart from the bottom surface of the machine room. Accordingly, a discharge space may be defined between the lower surface of the control module and the bottom surface of a machine room module, and the control module may not prevent the flow of air discharged through the outlet.

Additionally, an installation rail may be provided on the upper part of the machine room module in a direction parallel to the open direction of the outlet, and the control module may be assembled with the installation rail, and may move inside and outside the outlet along the installation rail. The control module may efficiently move in and out of the machine room due to the structure of the installation rail.

The control module may be installed on the lower surface of the cover plate in parallel thereto. Accordingly, in a horizontal lying state, a circuit board constituting the control module may be stored inside a receiving casing which is a kind of drawer structure, and thus may be stably stored therein even if the circuit board is not fastened with a separate fastener.

In addition, the control module may be configured to have a vertical height smaller than the entire height of the discharge space of the machine room, and thus the discharge space may be defined between the lower surface of the control module and the bottom surface of the machine room module.

In addition, the entrance of an introduction space may be configured to have an area larger than the area of the exit of the discharge space, and accordingly, outside air for dissipating heat of the condenser may be efficiently provided.

Furthermore, the receiving casing of the control module may be assembled removably with the upper part of the machine room, and a receiving space may be defined in the center of the receiving casing. A main control board may be received in the receiving space of the receiving casing, and may be connected to an external part by a wire harness.

Furthermore, a guide end assembled with the installation rail may protrude on the receiving casing of the control module, and may extend along each of the opposite side surfaces of the receiving casing. Through such a simple structure, the control module may be easily fixed inside the machine room.

In addition, the receiving casing of the control module may be open toward the lower surface of the cover plate covering the upper part of the machine room. Accordingly, as soon as the receiving casing is taken out, the main control board may be exposed to the outside for the maintenance thereof, but when the receiving casing is assembled with the machine room, the cover plate may function as a kind of cover and may cover the receiving space.

The receiving space in which the main control board is received may be defined in the center of the receiving casing of the control module, and a wire connection space may be defined outside the receiving space by surrounding the receiving space, and a partition wall may protrude between the receiving space and the wire connection space. The partition wall may not only partition the receiving space, but also prevent foreign matter from being introduced into the receiving space.

The control module may be provided with a casing guide fixedly mounted to the cover plate covering the upper surface of the machine room, and the casing guide may guide the moving in/out of the receiving casing.

Furthermore, a separation wall may be provided in the machine room so as to divide the machine room into left and right sides, and in the machine room, the introduction space in which the condenser is disposed, and the discharge space in which the compressor is disposed may be separated from each other by the separation wall. In this case, in the discharge space, the control module may be mounted to the upper surface of the machine room and may be spaced apart from the bottom surface of the machine room.

A harness cover may be mounted to the opening of the cover plate, and the wire harness may be guided through the harness cover to a side above the machine room. Accordingly, the organization of the wire harness may be facilitated.

In addition, a harness receiving space may be defined inside the harness cover by being recessed therefrom. The harness receiving space may extend in the moving in/out direction of the receiving casing, and may receive the wire harness during the moving in/out of the receiving casing.

Furthermore, an inner edge may be formed on the bottom surface of the receiving casing by extending upward therefrom along the periphery of the main control board so as to define space to receive the main control board.

In addition, the condenser installed in the machine room may face the entrance of the introduction space, and each of the compressor and the heat dissipation fan installed in the machine room may be installed in front of a rear plate of the machine room module. In this case, the cover plate may cover the upper part of the machine room, and a first cover part of the cover plate covering the upper part of the condenser and a second cover part of the cover plate covering the upper parts of the compressor and the heat dissipation fan may be configured to have heights different from each other.

Advantageous Effects

The refrigerator of the present disclosure described above has the following effects.

According to the present disclosure, in the machine room, the control module as well as devices for the implementation of the cooling system and may be installed and thus space utilization rate may be increased. In this case, the control module may be installed at a position close to the entrance of the machine room and may be removed from the front of the machine room. Accordingly, for maintenance of the control module, the rear of the refrigerator may not be required to be opened, and the control module may be removed from the front of the refrigerator to be repaired or replaced, thereby improving maintainability of the control module.

Particularly, when the machine room of the present disclosure is applied to a built-in refrigerator, without taking the entirety of the refrigerator out of an installation place thereof, a maintenance work may be performed in front of the refrigerator, thereby further improving work convenience.

In addition, the machine room may be disposed under the cabinet, thereby minimizing the loss of the inner storage space of the cabinet and maximizing the volumetric efficiency of the storage space in the same volume of the refrigerator.

Furthermore, according to the present disclosure, the control module may be assembled slidably with the machine room module without a separate fastener, and thus the installation and disassembly of the control module may be easily performed. In this case, when the front cover covering the front surface of the machine room is removed therefrom, the control module may be exposed to the front side, thereby further facilitating the removal of the control module.

Additionally, according to the present disclosure, the control module may not be installed at the upper side of the inlet of the machine room, but at the upper side of the outlet thereof. To improve efficiency in a device such as a refrigerator to which a refrigeration cycle is applied, it is important to dissipate heat of the condenser and the compressor, and although the control module is installed in the machine room, the introduction of outside air for heat dissipation may not be disturbed as much as possible.

In addition, in a horizontal lying state, a circuit board constituting the control module may be stored inside the receiving casing which is a kind of drawer structure, and thus may be stably stored therein even if the circuit board is not fastened with a separate fastener.

In this case, since the control module may be received in the machine room in a horizontal lying state in the width direction of the machine room rather than the height direction thereof, at least a left-to-right installation interval of the control module corresponding to the width direction of the outlet may be secured. Accordingly, the area of the circuit board constituting the control module may be sufficiently increased, and various functions may be given in one wide circuit board, thereby simplifying the structure of the control module.

Furthermore, according to the present disclosure, the receiving casing constituting the control module may be configured to be open upward without a separate cover, and thus when an operator removes the control module forward, parts of the control module such as the circuit board may be immediately checked with the naked eye. Accordingly, in the maintenance process of the control module, sufficient visibility may be secured even in a narrow lower space.

Additionally, according to the present disclosure, the control module may be installed on the lower surface of the cover plate covering the upper part of the machine room, and thus even without a separate cover, the lower surface of the cover plate may cover the upper part of the control module. That is, when the control module is installed in the machine room, the cover plate may function as a kind of cover, and accordingly, even without a separate cover, the introduction of foreign matter such as dust into the control module may be prevented, thereby decreasing the number of parts.

In addition, the wire connection space may be secured in the receiving casing constituting the control module of the present disclosure by surrounding the edge thereof, and thus multiple strands of wires extending from the circuit board may be effectively organized. Particularly, in the narrow machine room, multiple strands of wires are highly likely to be twisted or interfere with other parts, but according to the present disclosure, through the wire connection space, the wires may be organized, thereby improving the installation convenience of the control module.

Furthermore, the control module of the present disclosure may be installed on the cover plate covering the upper part of the machine room instead of a frame constituting the machine room. Accordingly, vibration generated by the compressor installed on the bottom surface of the machine room may be prevented from being transmitted directly to the control module, thereby improving the operation reliability of the control module.

Additionally, even if a wire harness connected to the main control board moves in and out of the receiving casing, the wire harness may have a sufficient length, and may be received in the harness cover. Accordingly, while the wire harness is connected to the main control board, the wire harness may move in and out of the receiving casing, and thus even during the operation of the refrigerator, the receiving casing may be moved out for an operator to work, thereby further improving work convenience.

In addition, the wire harness guided through the harness cover may be easily assembled with a plate connector disposed on the upper surface of the cover plate, thereby further facilitating the connection of the wire harness with each of electronic parts inside the cabinet and the machine room and improving productivity.

Furthermore, the control module may be disposed at the exit side of the discharge space inside the machine room and may be disposed at a position through which air discharged from the inside of the machine room passes. Accordingly, even without a separate device for cooling, the control module may be cooled through an air flow inside the machine room, thereby improving cooling efficiency and reducing power consumption.

MODE FOR INVENTION

Figure 1:
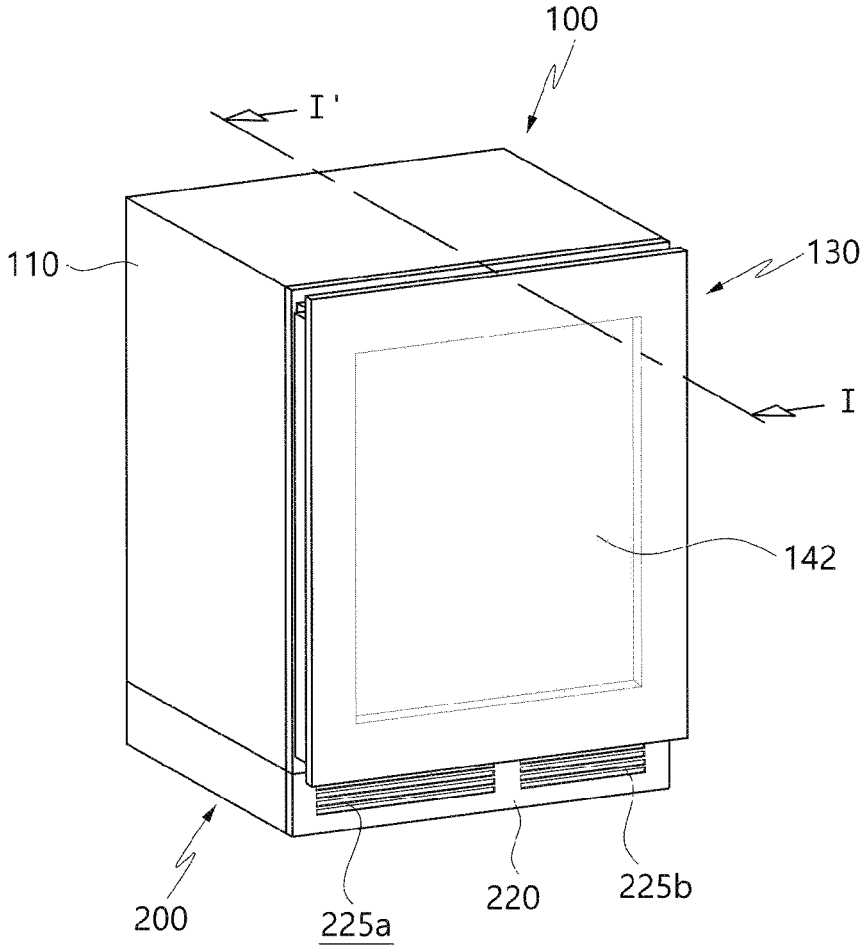
FIG. 1 is a perspective view illustrating the exterior of a refrigerator according to an embodiment of the present disclosure.

Hereinafter, some embodiments of the present disclosure will be described in detail with reference to exemplary drawings. In adding reference numerals to parts in each drawing, it should be noted that the same parts are assigned the same reference numerals as much as possible even though they are indicated in different drawings. Furthermore, in describing the embodiments of the present disclosure, when it is determined that a detailed description of a related known configuration or function interferes with an understanding of the embodiments of the present disclosure, a detailed description thereof will be omitted.

An embodiment of a refrigerator of the present disclosure will be described with reference to the accompanying drawings. For reference, a built-in type refrigerator to which a machine room module is applied has been described as an example below, but the machine room module of the present disclosure may be applied to various devices having a machine room module to which a refrigeration cycle is applied such as a general refrigerator, a wine refrigerator, a kimchi refrigerator, a beverage store device, a plant cultivation device.

The refrigerator of the present disclosure may largely include a cabinet 100, the machine room module, the beds 300*a* to 300*d*, a barrier 400, and grille fan modules 500*a* and 500*b*. Among these, the beds 300*a* to 300*d*, the barrier 400, and the grille fan modules 500*a* and 500*b* may be installed in the cabinet 100, and a door assembly 130 may be assembled with the front surface of the cabinet 100. Additionally, the machine room module may be assembled with the lower part of the cabinet 100.

Referring to FIG. 1, the cabinet 100 may constitute the exterior of the refrigerator, and as illustrated in the drawing, may be made to have a low overall height. The refrigerator according to the embodiment is a built-in type refrigerator installed inside an island table, etc., and has a lower height than a general refrigerator. Accordingly, the refrigerator may have a small internal capacity and a small space in which each part can be installed. Accordingly, in order to utilize a small and low installation space, parts are required to be effectively arranged. To this end, in the embodiment, a control module 700 may be installed in the machine room module. Such a structure will be described below.

Figure 2:
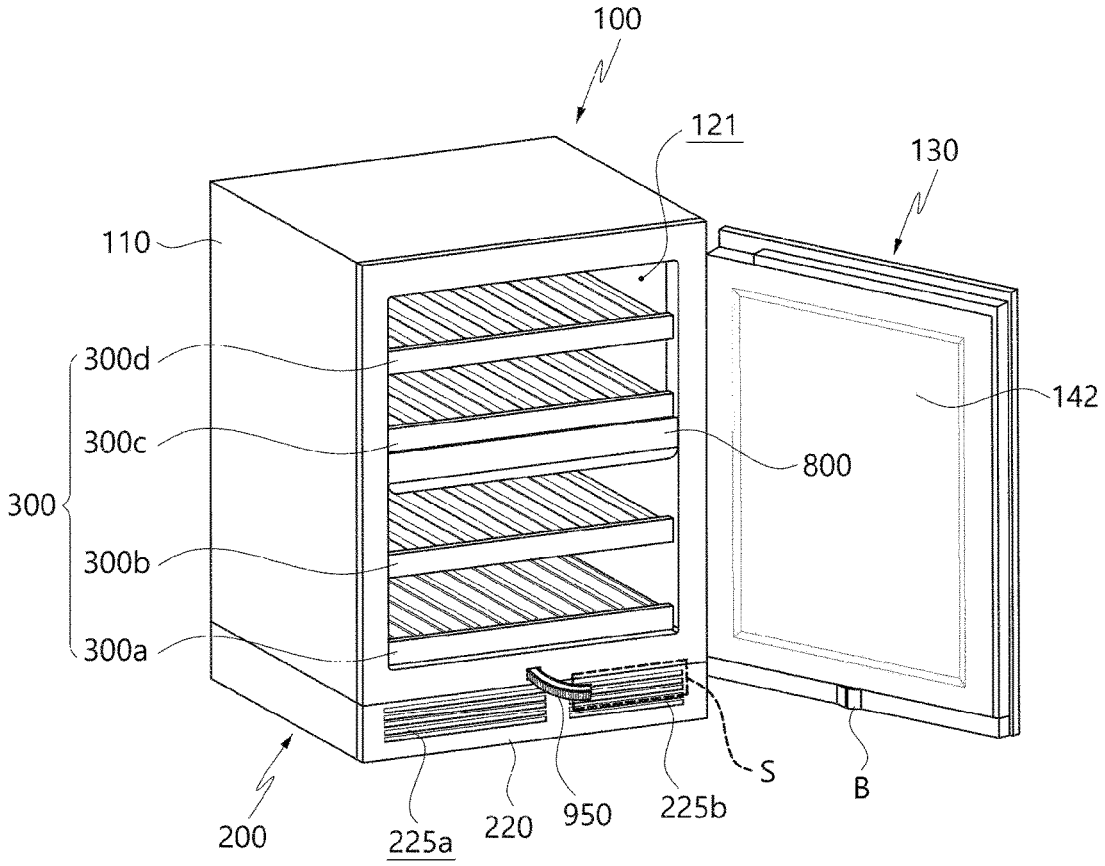
FIG. 2 is a perspective view illustrating a state in which a door assembly is opened in the refrigerator of FIG. 1.
Figure 3:
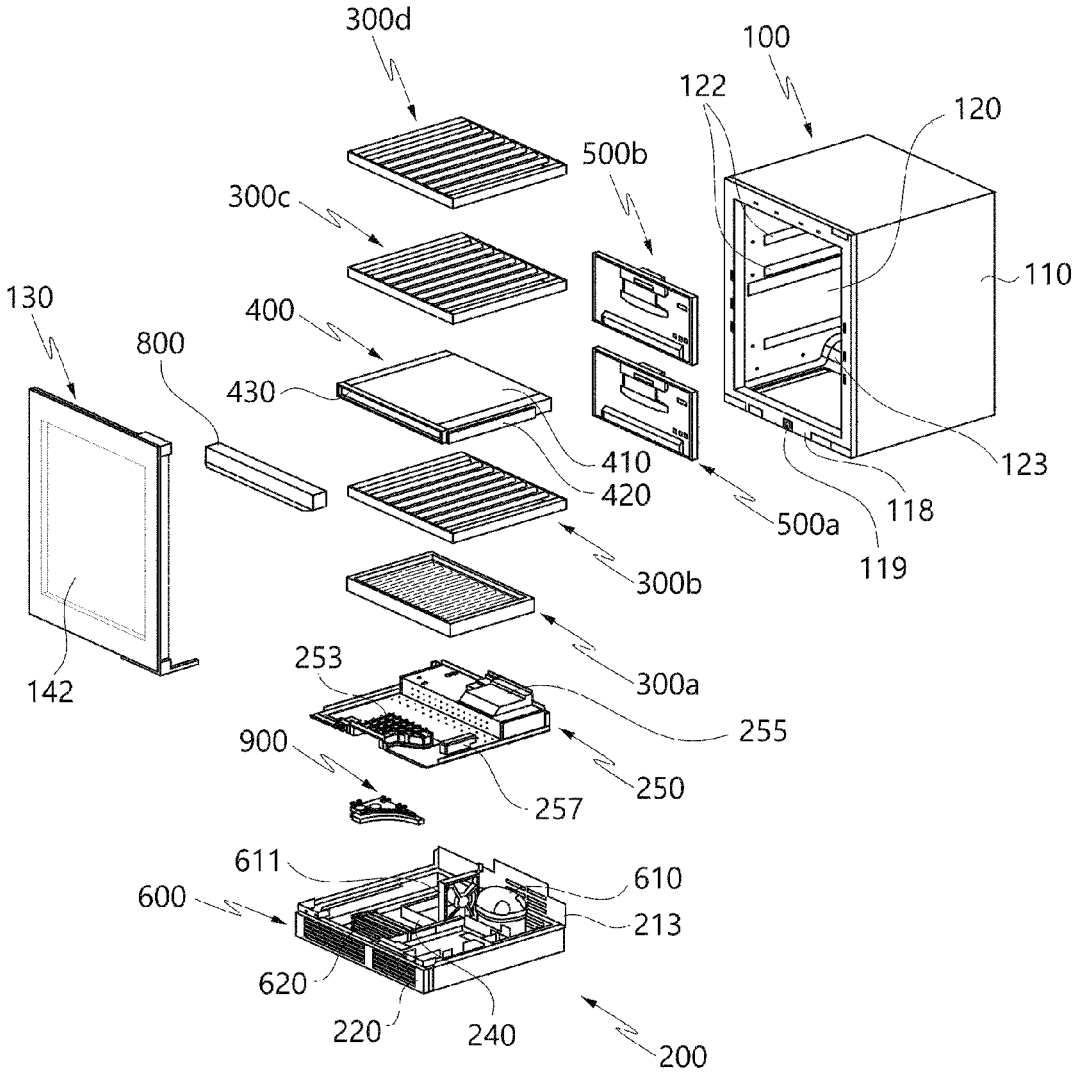
FIG. 3 is a perspective view illustrating the exploded state of parts of the refrigerator according to the present disclosure.

The cabinet 100 may be configured as a casing having an open front surface, and may include multiple parts. The cabinet 100 may largely include an outer casing 110 constituting an outer wall surface thereof, and an inner casing 120 constituting an inner wall surface thereof. As illustrated in FIGS. 2 and 3, the front surface of the cabinet 100 may be open, and may be selectively covered by the door assembly 130. When the door assembly 130 is opened, a storage space 121 may be open forward.

Figure 4:
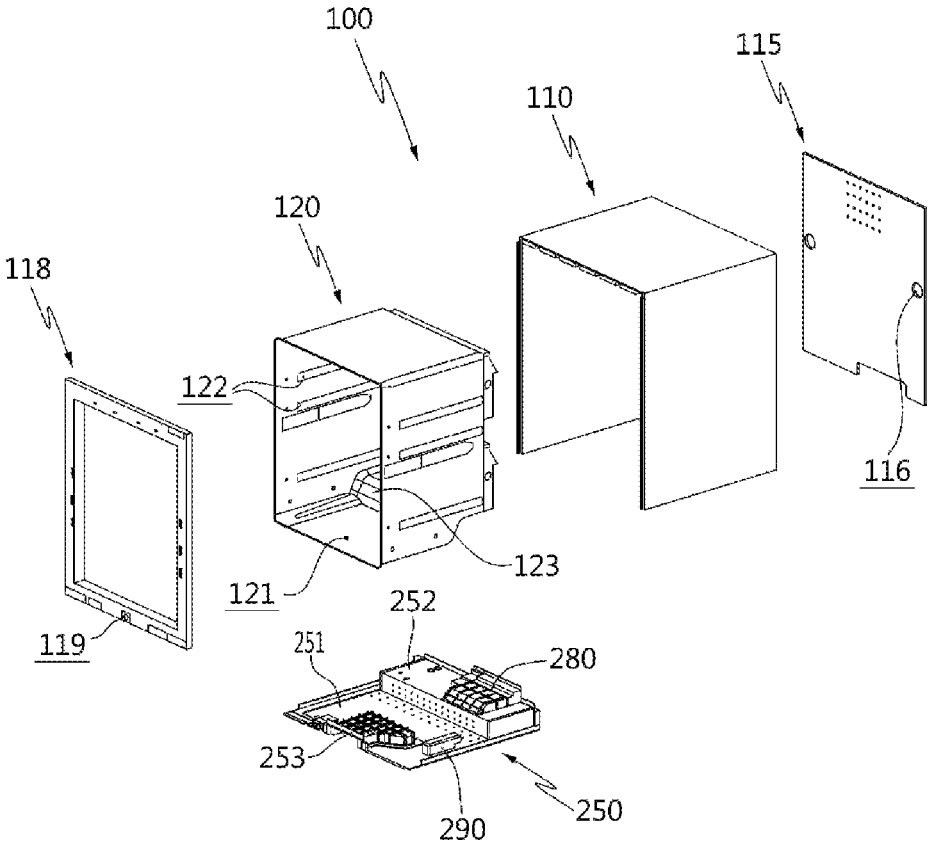
FIG. 4 is a perspective view illustrating the exploded state of parts of a cabinet constituting the refrigerator according to the present disclosure.

In FIG. 4, parts constituting the cabinet 100 are illustrated by being exploded. As illustrated in the drawing, the outer casing 110 may have an approximately hexahedral shape open forward, rearward, and downward, and the inner casing 120 may be installed inside the outer casing 110 to be spaced apart from the outer casing 110. Additionally, a back plate 115 may be assembled with the rear surface of the outer casing 110, a front frame 118 may be assembled with the front surface of the outer casing 110, and a cover plate 250 may be assembled with the lower surface of the outer casing 110.

While each of the back plate 115, the front frame 118, and the cover plate 250 is assembled with the outer casing 110 a state in which the inner casing 120 is located inside the outer casing 110, a foam insulation material (not shown) may be filled in space between the inner casing 120 and the outer casing 110. In this case, a filling hole 116 may be formed through the back plate 115, and the foam insulation material may be injected into the space through the filling hole 116.

Accordingly, when the foam insulation material is filled in the space between the outer casing 110 and the inner casing 120, a portion of a wire harness (not shown) to be described below, a side condensing tube L4 and L6 (see FIG. 6), and a front condensing tube L8 may be mounted in a foam layer. Accordingly, a portion of the wire harness and a side condenser may be fixed naturally in the process of filling the foam insulation material.

The storage space 121 may be present in the cabinet 100. The storage space 121 is space in which food is stored, and the storage space 121 may be divided into multiple compartments by the beds 300*a* to 300*d*. A guide rail 122 may be provided on the inner wall surface of the storage space 121, and the beds 300*a* to 300*d* may be configured to move forward/rearward under the guidance of the guide rail 122 such that the beds can be taken out from or taken in the storage space 121 in a drawer type.

An avoidance part 123 may be provided on the bottom surface of the storage space 121. The avoidance part 123 is a part protruding upward from the bottom surface of the storage space 121. The avoidance part 123 is intended to avoid interference with the compressor 610 of the machine room module to be described below. Due to the avoidance part 123, a portion of the bottom of the storage space 121 may have a stepped space.

The door assembly 130 may be provided on the front surface of the cabinet 100. Such a door assembly 130 is intended to open and close the storage space 121 of the cabinet 100. In the embodiment, the door assembly 130 may be configured to be opened and closed by rotating. More precisely, the door assembly 130 may be in close contact with the front frame 118 of the cabinet 100 so as to cover the storage space 121, or may be moved away from the front frame 118 by rotating so as to open the storage space 121.

That is, due to the door assembly 130 described above, the refrigerator according to the embodiment of the present disclosure may have the sealed storage space 121. Particularly, the sealed storage space 121 may store food while maintaining a predetermined temperature without loss of cold air due to the grille fan modules 500*a* and 500*b* and an air conditioning module 600. In the embodiment, at least a portion of the door assembly 130 may be made to have the structure of a transparent see-through window 142 such that the storage space 121 can be checked from the outside.

In this case, the see-through window 142 is preferably made of a material through which the inside of the storage space can be seen, and for example, may be formed of glass. When the see-through window 142 is formed of glass, a protective film (not shown) may be attached to the glass. In this case, the protective film is preferably made of a light blocking (partially) film which minimizes penetrating of light in the storage space 121 into a room. Of course, instead of the protective fi, the see-through window 142 may be formed to have a dark color and may be configured to minimize light penetration into the room.

Next, the machine room module 200 will be described. The machine room module 200 is provided to constitute the lower structure of the refrigerator according to the embodiment of the present disclosure. The air conditioning module 600 to be described below may be installed in the machine room module 200, and the cabinet 100 described above may be coupled to the upper part of the machine room module 200.

As illustrated in FIG. 1, such a machine room module 200 may be installed on the lower side of the outer casing 110, and as illustrated in FIG. 3, may have the shape of an approximately rectangular frame. In the embodiment, the machine room module 200 may be open in an upper part thereof and may have a machine room 201 therein, and at least a portion of the air conditioning module 600 may be installed therein. Here, the machine room 201 is space separated from the storage space 121, and a machine room frame may be a portion of the cabinet 100, or may be assembled with the cabinet 100.

Figure 7:
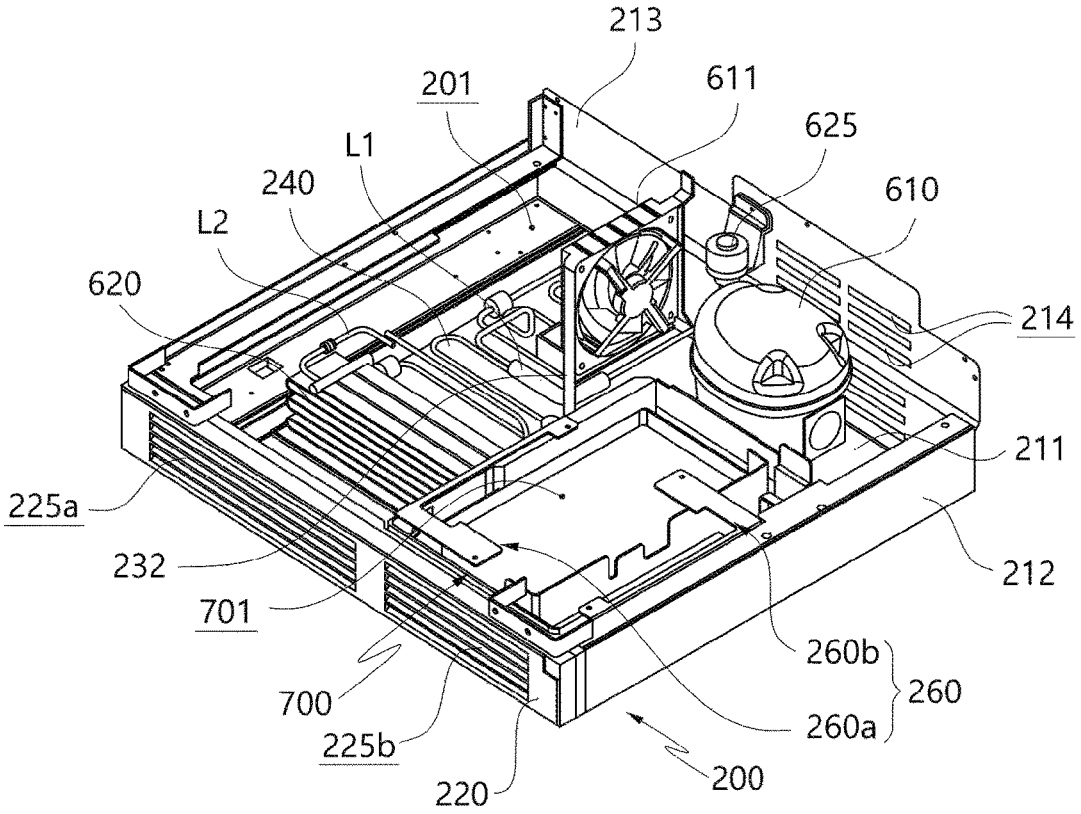
FIG. 7 is a perspective view illustrating a machine room module according to the embodiment of the present disclosure.

Referring to FIG. 7, the machine room module 200 may include a bottom plate 211 constituting a bottom thereof, a side plate 212 constituting each of opposite side wall surfaces thereof, and a rear plate 213 constituting a rear surface thereof. A separate outer plate 212*a* may be coupled to the side plate 212, and may constitute the outermost side surface of the machine room module.

In addition, the cover plate 250 (see FIG. 3) may be coupled to the upper part of the machine room module 200, and may cover the inside of the machine room 201. In the embodiment, the cover plate 250 may be assembled with the lower part of the cabinet 100 and may be considered as a portion of the cabinet 100, but may constitute the upper part of the machine room module 200 and thus may be considered as a portion of the machine room module 200. These machine room module 200 and machine room 201 may be separated from the storage space 121, and the machine room module 200 may be configured to be removable from or integrally with the cabinet 100.

A heat dissipation hole 214 (see FIG. 7) may be formed through the rear plate 213 of the machine room module 200. Such a heat dissipation hole 214 is a hole formed to discharge (or introduce) air dissipating the heat of the compressor 610 to be described later. That is, the heat dissipation hole 214 may be formed to more facilitate the discharge of air. Although not shown, a discharge hole may be formed even in the bottom plate 211 of the machine room module 200 so as to discharge air dissipating the heat of the compressor 610.

In this case, the machine room module 200 and the inner casing 120 may be disposed to be spaced apart from each other, and the side plates 212 and the rear plate 213 of the machine room module 200 may be configured to be connected to the opposite side surfaces and rear surface of the outer casing 110, respectively.

The machine room 201 (see FIG. 7) may be present in the machine room module 200. The machine room 201 is an empty space which is a kind of installation space, and may have a portion of a device constituting the air conditioning module 600 installed therein. The machine room 201 is a separate space independent of the storage space 121 described above, and provides space in which the air conditioning module 600 is installed and operates. Here, the machine room 201 is space separated from the storage space 121, and the machine room frame may be a part of the cabinet 100 or may be a separate part from the cabinet 100 to be assembled with the cabinet 100.

Although not shown, the inner casing 120 and the machine room module 200 may be configured as one part. In this case, a separate partition wall may be provided between the storage space 121 and the machine room 201 such that the storage space 121 and the machine room 201 can be separated from each other.

A front cover 220 may be provided on the open front surface of the machine room module 200 which is the front of the machine room 201. The front cover 220 may function to guide the flow of air introduced into the machine room 201 from the outside thereof or air discharged to the outside of the machine room 201 from the inside thereof, and to cover the open front surface of the machine room 201. Accordingly, the front cover 220 may be considered as a front cover of the machine room 201.

In addition, an inlet 225*a* and an outlet 225*b* may be formed in the front cover 220 described above. In this case, the inlet 225*a* and the outlet 225*b* may be provided at positions separated from each other by the separation wall 230 to be described later. In the embodiment of the present disclosure, when viewed from the front side, the inlet 225*a* is provided at the left side and the outlet 225*b* is provided at the right, but the inlet 225*a* may be provided at the right side and the outlet 225*b* may be provided at the left side. For reference, referring to FIG. 6 in which the front cover 220 is removed from the machine room module 200, the inlet 225*a* which is the entrance of an introduction space I and the outlet 225*b* which is the exit of a discharge space O are exposed to the entrance of the front surface of the machine room module 200.

The separation wall 230 which divides the machine room 201 into two spaces is provided in the machine room module 200. That is, a flow path through which air is introduced into the machine room 201 and a flow path through which air is discharged may be separated from each other by the separation wall 230. The inlet 225*a* of the front cover 220 may be located in the flow path through which air is introduced into the machine room 201 may start from, and the outlet 225*b* of the front cover 220 may be located in the flow path through which air is discharged from the inside of the machine room 201.

In addition, the left and right spaces of the inside of the machine room 201 separated from each other by the separation wall 230 may be connected to each other at the rear of the machine room 201, that is, at a position close to the rear plate 213. That is, the rear end portion of the separation wall 230 may be configured to be spaced apart from the rear plate 213 so as not to reach the rear plate 213, so a part at which the left and right spaces are connected to each other may be generated. Of course, although not shown, the rear end portion of the separation wall 230 may be in contact with the rear plate 213, and may have an opening (not shown) formed therein such that the inner opposite sides of the machine room 201 communicate with each other.

In addition, the separation wall 230 may be formed in a straight line, but may be formed to have an inclined or bent structure. In the embodiment of the present disclosure, the separation wall 230 is configured to have a bent structure. That is, a portion of the separation wall 230 may be formed to be bent, so space in which the main condenser 620 to be described later is installed may be secured as much as possible.

Figure 6:
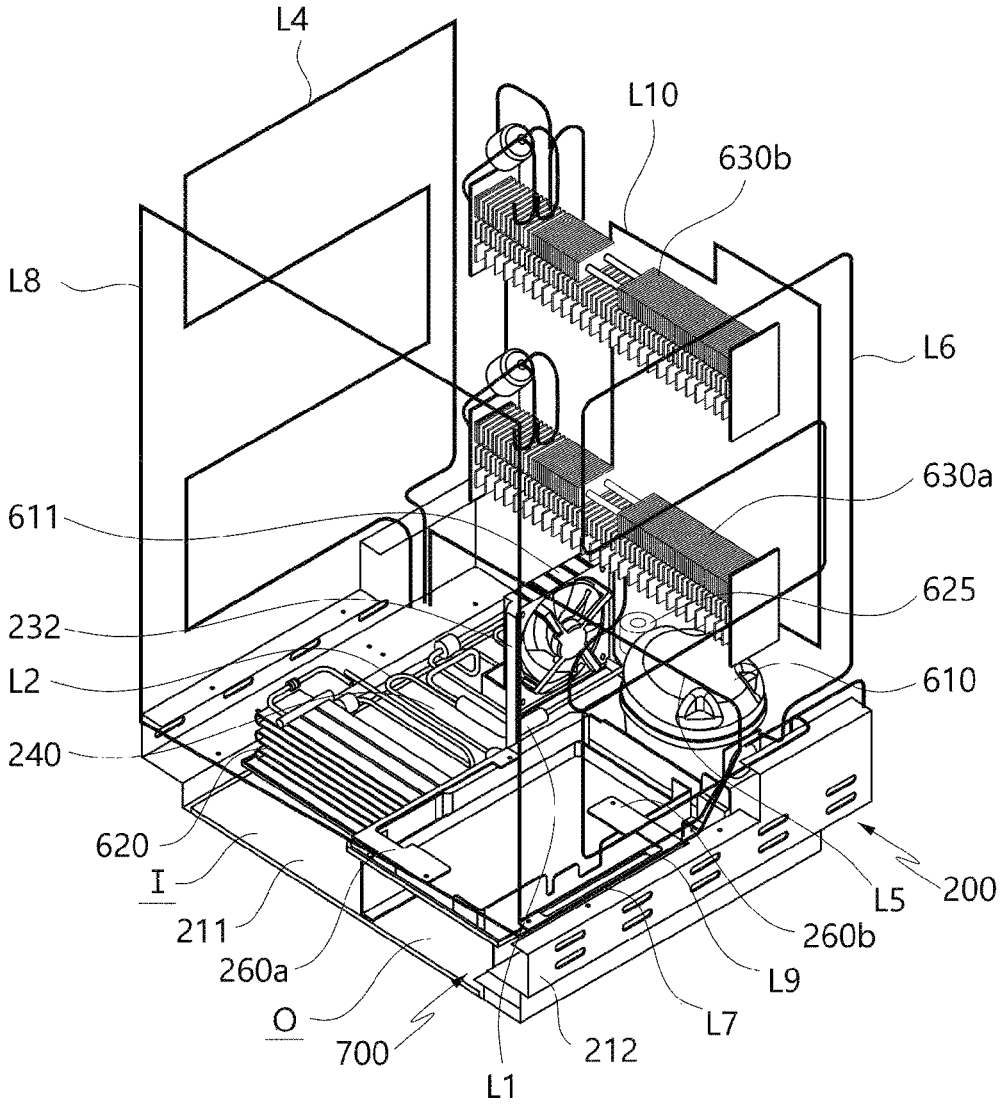
FIG. 6 is a perspective view illustrating parts for implementing a refrigeration cycle of the refrigerator according to the embodiment of the present disclosure.
Figure 8:
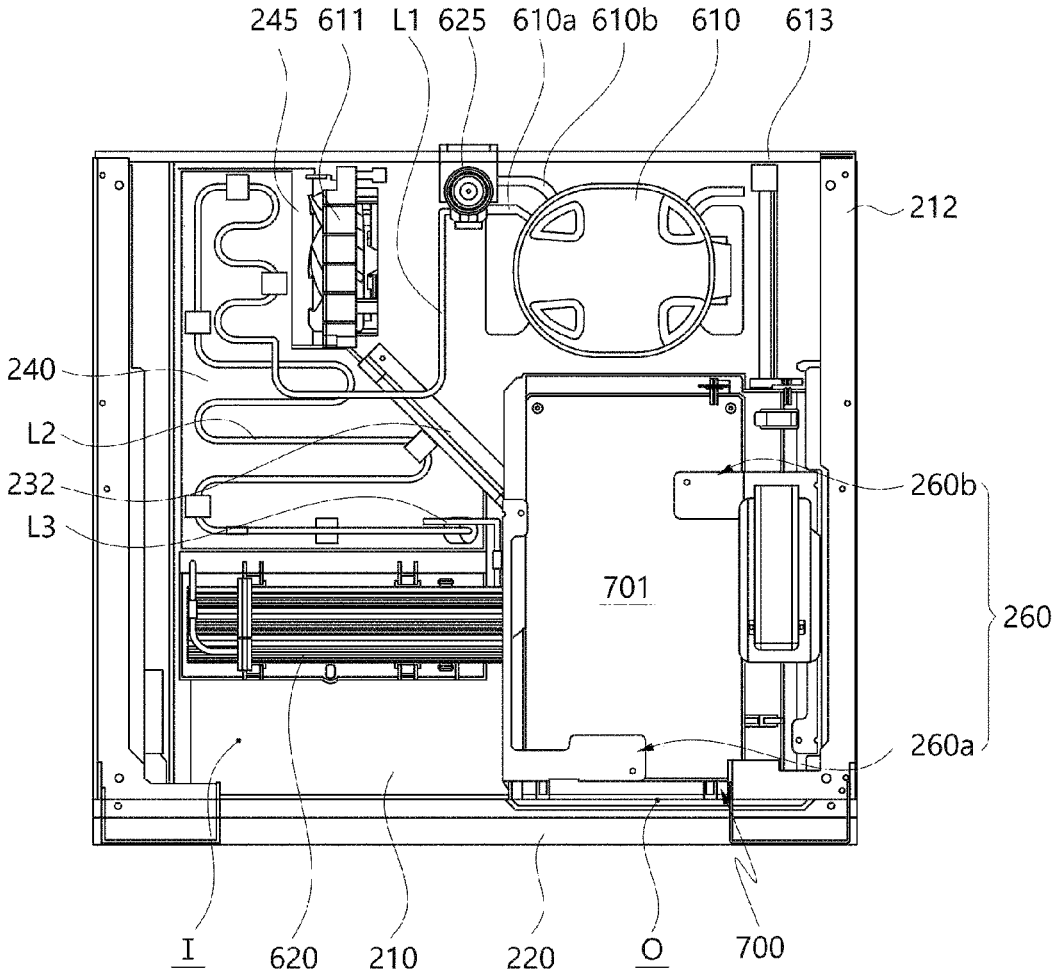
FIG. 8 is a top plan view illustrating the machine room module according to the embodiment of the present disclosure.
Figure 9:
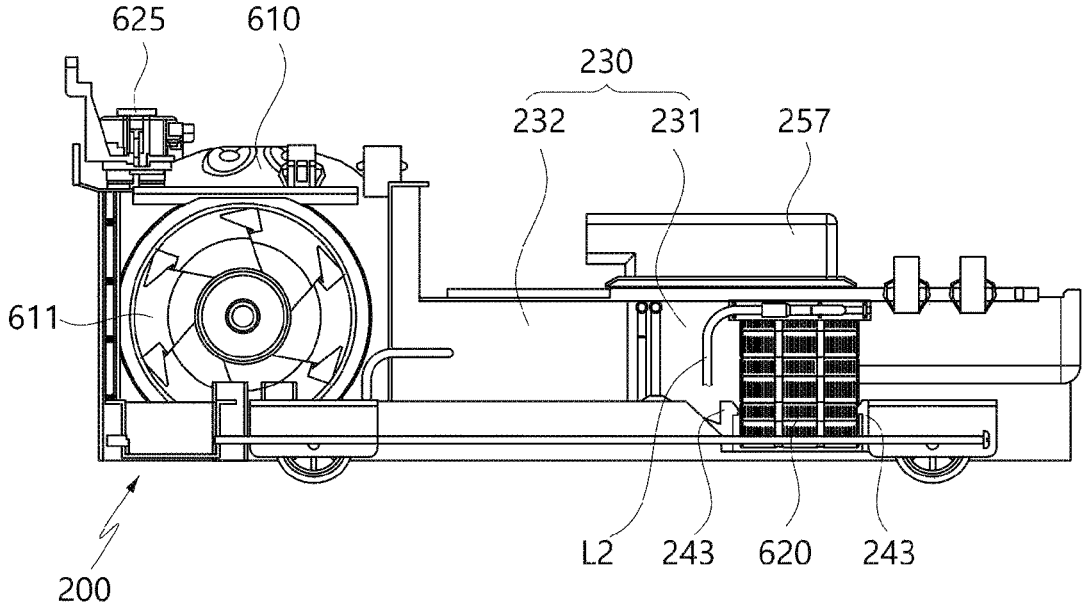
FIG. 9 is a side view illustrating the machine room module according to the embodiment of the present disclosure.

The separation wall 230 may include a first wall 231 extending toward the inside of the machine room 201 between the inlet 225*a* and the outlet 225*b*, and a second wall 232 extending from the first wall 231 in an inclined direction. In FIGS. 6 to 8, although the first wall 231 is not seen due to the control module 700, the second wall 232 is illustrated. In FIG. 9, the first wall 231 is illustrated, and as illustrated in FIG. 9, the main condenser 620 is disposed in space divided by the first wall 231. For reference, a reference numeral 243 in FIG. 9 indicates a condenser fixing part protruding from a defrost water tray 240 and supporting the main condenser 620.

The height of the first wall 231 may be greater than or equal to the height of the main condenser 620. Additionally, the second wall 232 may be connected from an end of the first wall 231 to an end of the heat dissipation fan 611 to be described below. Accordingly, the second wall 232 may prevent introduced air from flowing directly toward the compressor 610 without passing through the heat dissipation fan 611. Such first wall 231 and second wall 232 may be configured as one part or as separate parts.

The defrost water tray 240 may be provided in the machine room 201 of the machine room module 200. In this case, the defrost water tray 240 described above may be located on the bottom of a side to which air is introduced through the inlet 225*a* in the machine room 201, and may function to collect defrost water falling down from the evaporator 630*a* and 630*b* to be described later and to fix the main condenser 620 in the machine room 201.

A flow guide surface 245 may be formed on the defrost water tray 240. The flow guide surface 245 may be formed on the front side of the heat dissipation fan 611, and, more precisely, on the lower end of the defrost water tray 240 facing the heat dissipation fan 611. The flow guide surface 245 may form a kind of flow space such that the defrost water tray 240 and the heat dissipation fan 611 can be naturally connected to each other.

Meanwhile, referring to FIG. 3, the rear portion of the cover plate 250 constituting the upper surface of the machine room module 200 may protrude upward from other portions of the cover plate, and the rear portion of the inside of the machine room 201 may be configured to be higher than other portions thereof. That is, in consideration of the protruding heights of the heat dissipation fan 611 and the compressor 610 installed in the machine room 201, the rear portion of the cover plate may be configured to be higher than the other portions thereof. Particularly, in the embodiment, since the compressor 610 has the highest height, a compressor cover 280 may be provided in the cover plate 250 in correspondence to the height of the compressor 610.

More precisely, as illustrated in FIG. 4, the cover plate 250 may be formed by bending a material having a metal plate shape. Additionally, the cover plate 250 may include a first cover part 251 constituting a front half part thereof, and a second cover part 252 constituting a rear half part thereof. The first cover part 251 may be configured to have a height to be in contact with the upper surface of each of the condenser 620 and the separation wall 230 provided in the machine room 201, and may be configured to have a relatively low height.

In addition, the second cover part 252 may be configured to be in contact with the upper end of the heat dissipation fan 611 provided inside the machine room 201, and may be configured to be higher than the first cover part 251. That is, the rear half part of the cover plate 250 is configured to be higher than the front half part thereof to be stepped therefrom. Meanwhile, a vertical connection part 254 may be formed on the rear end of the first cover part 251 by extending vertically, and the upper end of the vertical connection part 254 may include the second cover part 252 extending rearward.

In this case, the side plate 212 constituting the side surface of the machine room 201, and the outer plate 212*a* coupled to the side plate 212 and constituting the outermost side surface of the machine room may all be configured to have the same heights from the front of the machine room 201 to the rear thereof. In contrast, the second cover part 252 may be configured to be higher than the side plate 212 or the outer plate 212*a*.

The auto door installation part 253 in which a door opening device 900 is installed may be provided in the cover plate 250. The auto door installation part 253 may be provided on the front part of the cover plate 250, that is, on a front side thereof directed toward the door assembly 130, and may protrude upward to secure space under the auto door installation part and the lower side of the auto door installation part may be open. Just as the rear part of the cover plate 250 protrudes upward, the auto door installation part 253 may protrude upward, but in the embodiment, the protruding degree of the auto door installation part 253 may be smaller than the protruding degree of the rear part of the cover plate 250.

For reference, in FIG. 2, an open bar 950 constituting the door opening device 900 is illustrated by protruding therefrom. The open bar 950 may protrude from the door opening device 900 and may push a contact part B provided on the inner surface of the door assembly 130.

The cover plate 250 may be provided with a harness cover 257. The harness cover 257 is a part in which the wire harness extending from the control module 700 to be described below is mounted and may function to guide the extending direction of the wire harness. Specifically, the harness cover 257 may guide the wire harness extending upward from the control module 700 located thereunder to the rear side, that is, toward the rear plate 213.

Next, the beds 300*a* to 300*d* will be described. The beds 300*a* to 300*d* may be installed in the storage space 121, and may function to divide the storage space 121 into several layers. However, the beds 300*a* to 300*d* may not divide the storage space 121 into several layers having spaces completely independent of each other, but each of the layers may communicate with each other. To this end, in the embodiment, each of the beds 300*a* to 300*d* may have gaps open vertically.

Each of these beds 300*a* to 300*d* may be configured as a flat plate or a tray structure having a peripheral wall such that food can be seated on an upper surface thereof. Additionally, the guide rail 122 (see FIG. 3) may be provided on each of the inner opposite wall surfaces (the inner opposite wall surfaces of the inner casing 120) of the storage space 121, and the opposite side surfaces of each of the beds 300*a* to 300*d* may move forward/rearward under the guidance of the guide rails 122 to be taken from or in the storage space 121 in a drawer type. Although not shown, the beds 300*a* to 300*d* may be configured to have other various structures so as be taken in or out in a drawer type.

The beds 300*a* to 300*d* may include multiple beds and the barrier 400 may be located therebetween. The barrier 400 may be installed parallel to the beds 300*a* to 300*d* by crossing the storage space 121 and may divide the storage space 121. Unlike the beds 300*a* to 300*d*, the barrier 400 may divide the storage space 121 into spaces independent of each other, and accordingly, relative to the barrier 400, upper and lower parts thereof may be spaces different from each other. Accordingly, the upper and lower spaces of the barrier 400 may be controlled independently of each other to have temperatures different from each other.

A display module 800 may be installed on the front surface 430 of the barrier 400. The display module 800 may display the each state of the refrigerator and a part provided to perform various controls. The each state displayed through the display module 800 may be the temperature and operation mode of the inside of the storage space 121.

The display module 800 may be configured to be manipulated in a touch type, a button type, or a switch type. In this case, the display module 800 may be provided on the cabinet 100, and may be provided on the door assembly 130. However, when the display module 800 is provided on the door assembly 130, the connection structure of various signal lines or power lines may be inevitably complicated. In consideration of this, the display module 800 is more preferably provided on the cabinet 100.

Furthermore, when it is considered that the see-through window 142 constituting the inner portion of the door assembly 130 is formed of glass through which the inside can be seen, the display module 800 is most preferably installed on the front of the barrier 400 installed at the middle height of the storage space 121.

Next, looking at the grille fan modules 500*a* and 500*b*, the grille fan modules 500*a* and 500*b* are components provided to circulate air of the inside of the storage space 121. Each of such grille fan modules 500*a* and 500*b* may be provided in front of a rear wall surface constituting the inner casing 120, and may be configured to discharge air to an upper side in the associated storage space 121 after introducing the air from a lower side in the associated storage space 121. In this case, the upper and lower sides in the storage space 121 may be determined relative to the middle height of the associated storage space 121.

Figure 5:
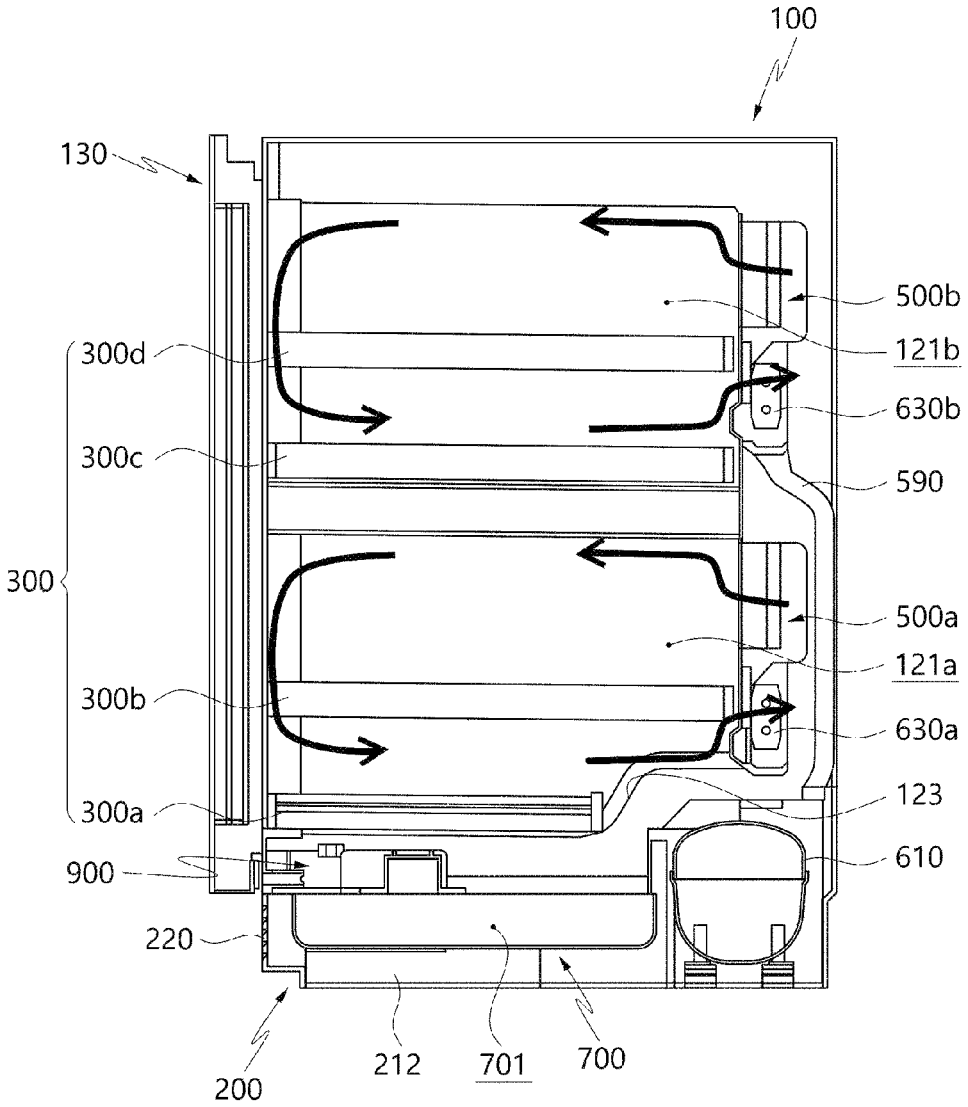
FIG. 5 is a sectional view taken along line I-I' of FIG. 1.

Meanwhile, the grille fan modules 500*a* and 500*b* may be provided in the upper and lower storage spaces 121, respectively, and one grille fan module 500*a* or 500*b* may be used and be configured to control air circulation of all of the storage spaces 121. As illustrated in FIG. 5, in the embodiment of the present disclosure, as an example, the grille fan modules 500*a* and 500*b* are provided in the storage spaces 121, respectively. That is, the grille fan modules 500*a* and 500*b* are installed respectively in the lower storage space 121*a* and the upper storage space 121*b* partitioned from each other relative to the barrier 400.

Although not shown, each of the grille fan modules 500*a* and 500*b* may include a circulation fan, a shroud, and a separation wall, and among these, the circulation fan is a fan driven to blow air, and may be configured as a centrifugal fan that introduces air in an axial direction and blows the air in a radial direction. In FIG. 5, arrows indicate the flow of air circulated in the lower storage space 121 and the upper storage space 121 by the grille fan modules 500*a* and 500*b*, respectively.

Next, the air conditioning module 600 will be described with reference to FIGS. 6 to. 9. The air conditioning module 600 is a part which controls temperature of the inside of the storage space 121 of the inner casing 120. Such an air conditioning module 600 may be configured as an air conditioning device including the compressor 610, the main condenser 620, and the evaporator 630*a* and 630*b*. That is, temperature of air circulating in the storage space 121 may be controlled by the above air conditioning device.

The compressor 610 and the main condenser 620 may be provided in the machine room 201 inside the machine room module 200. Here, the condenser 620 may refer to the main condenser 620. The main condenser 620 may be located at a side at which air is introduced among opposite sides formed by the separation wall 230 in the machine room module 200, and the compressor 610 may be located in a part through which air passing through the main condenser 620 passes. Particularly, the compressor 610 may be located at a side at which air is discharged.

Such a structure is intended such that air introduced into the machine room 201 of the machine room module 200 can first pass through the main condenser 620. That is, when it is considered that the compressor 610 is a part that generates a large amount of heat, heat exchange efficiency may decrease when air exchanges heat with the main condenser 620 after passing through the compressor 610. Accordingly, it is preferable that air passes through the main condenser 620 before the compressor 610.

In addition, the main condenser 620 may be located in the front side (a side adjacent to the open front surface) of the inside of the machine room 201, and the compressor 610 may be located in the rear side (a side adjacent to the rear plate 213) of the inside of the machine room 201. Such a structure may allow the compressor 610 and the main condenser 620 to be partitioned from each other as much as possible so as to be spaced apart from each other such that the impact of high-temperature heat of the compressor 610 on the main condenser 620 can be reduced.

Furthermore, the heat dissipation fan 611 may be provided in the air introduction side of the compressor 610 so as to allow air to be introduced into and discharged out of the machine room 201 and to dissipate heat of the compressor 610. Such a heat dissipation fan 611 may function to block an air introduction side at which the main condenser 620 is located from a part in which the compressor 610 is located, so the impact of high-temperature heat of the compressor 610 on the main condenser 620 may be reduced. To this end, the heat dissipation fan may be installed to be continuously connected to the separation wall 230 described above.

While refrigerant continuously flows through the inside of each part constituting the air conditioning module 600, a refrigeration cycle may operate. In this case, each part may be connected to multiple refrigerant tubes, and the evaporation tube L2, the side condensing tube L4 and L6, and the front condensing tube L8 to be described below may be included in the refrigerant tubes.

Referring to FIGS. 6 and 7, first, the evaporation tube L2 may be installed in the defrost water tray 240, and may be located close to the bottom surface of the defrost water tray 240. The evaporation tube L2 may be installed to be space apart by a predetermined distance from the bottom surface of the defrost water tray 240, and may be connected in a zigzag direction to secure length as long as possible as illustrated in FIG. 6. The evaporation tube may be a path which is connected through a main control valve 625 to a refrigerant discharge pipe 610*a* (see FIG. 8) of the compressor 610 such that high-pressure/high temperature refrigerant passes through the path. The evaporation tube L2 may be disposed close to the bottom surface of the defrost water tray 240, and thus may function to evaporate defrost water collected in the defrost water tray 240. Reference numeral L1 indicates a first connection tube which connects the main control valve 625 with the evaporation tube L2.

The evaporation tube L2 may be connected to the main condenser 620, and a first side condensing tube L4 may be connected to the main condenser 620. The first side condensing tube L4 may be provided on the left surface of the cabinet 100 relative to FIG. 6, and may be provided by bending multiple times. Referring to FIG. 8, a portion of a second connection tube L3 which connects the main condenser 620 with the first side condensing tube L4 is illustrated.

The first side condensing tube L4 may be connected to a second side condensing tube L6 by a third connection tube L5 (see FIG. 6) crossing the machine room 201. The second side condensing tube L6 and the first side condensing tube L4 may be paired with each other and may have the same shapes. Referring to FIG. 6, the second side condensing tube L6 may be provided on the right surface of the cabinet 100. Of course, the second side condensing tube L6 may not be required to have the same shape as the first side condensing tube L4.

The second side condensing tube L6 may be connected to the front condensing tube L8 by a fourth connection tube L7. The front condensing tube L8 may be provided on the front surface of the cabinet 100 and may be a refrigerant tube which is bent multiple times. In FIG. 6, the front condensing tube L8 may have an approximate rectangular shape, which is a shape corresponding to the front frame 118 described above.

Each of the first side condensing tube L4, the second side condensing tube L6, and the front condensing tube L8 may, together with the main condenser 620, perform the function of condensing refrigerant, so even if a large main condenser 620 is not installed in the machine room 201 due to the small height and width of the machine room 201, this may be compensated. Accordingly, each of the first side condensing tube L4, the second side condensing tube L6, and the front condensing tube L8, together with the main condenser 620, may be considered as a part of a condenser.

In addition, each of the first side condensing tube L4, the second side condensing tube L6, and the front condensing tube L8 may be configured to cover the exterior of the cabinet 100, and thus may function as a kind of heat line which prevents the formation of dew on the surface of the cabinet 100 due to temperature difference between the inside and outside of the refrigerator.

When a foam insulation material is filled in space between the inner casing 120 and the outer casing 110 as described above, the first side condensing tube L4, the second side condensing tube L6, and the front condensing tube L8 may be inserted and fixed in the insulation material.

Meanwhile, the second side condensing tube L6 may be connected to the evaporator 630*a* and 630*b* by a fifth connection tube L9. The evaporator 630*a* and 630*b* may be disposed in the rear space of the grille fan modules 500*a* and 500*b* in each portion in the inner casing 120. That is, during circulation of discharging air to the inner upper side of the storage space 121 after the air is introduced into the storage space 121 from the inner lower side thereof due to the operation of the grille fan modules 500*a* and 500*b*, the air may exchange heat with the evaporator 630 while passing through the evaporator 630*a* and 630*b*.

Such an evaporator 630*a* and 630*b* may be configured as an evaporator 630*a* and 630*b* having a plate shape, and may be stably installed in front of the rear wall surface among the inner wall surfaces of the inner casing 120 and may improve heat exchange performance in a small space. Reference numeral L10 indicates an evaporator connection tube which connects the evaporator 630*a* and 630*b* with the main control valve 625.

Although not shown, a dryer and a capillary tube may be installed between the front condensing tube L8 and the evaporator 630*a* and 630*b*. In this case, a refrigerant may pass consecutively through the front condensing tube L8, the dryer, the main control valve 625, the capillary tube, and the evaporator 630*a* and 630*b*. Here, the dryer may function to protect a system by removing moisture and filtering foreign mater, and the capillary tube may function to throttle as an expansion valve.

In addition, finally, a refrigerant passing through the evaporator 630*a* and 630*b* may be introduced back to a refrigerant introduction tube 610*b* (see FIG. 8) of the compressor 610 so as to repeat a refrigeration cycle.

Next, the control module 700 will be described with reference to FIGS. 10 to 15. The control module 700 may be installed in the machine room 201. The control module 700 is intended to control various functions of the refrigerator, and may control various functions such as the temperature control of the storage space 121, communication, and the display of information through a display module 800. Such a control module 700 may be installed inside the machine room 201 to save the inner space of the cabinet 100.

Looking at the installation structure of the control module 700 prior to the description of the control module 700, in the embodiment, the control module 700 may be installed on the lower surface of the cover plate 250. More precisely, the cabinet 100 may include the outer casing 110, and the inner casing 120 such that an insulation space is defined between the inner casing 120 and the outer casing 110, and the cover plate 250 may constitute the lower surface of the outer casing 110. Additionally, the control module 700 may be installed on the lower surface of the cover plate 250.

An installation rail 260 may be provided on the lower surface of the cover plate 250 in a direction parallel to the open direction of the outlet 225*b* such that the control module 700 can be moved inside and outside of the outlet 225*b* along the installation rail 260.

Figure 10:
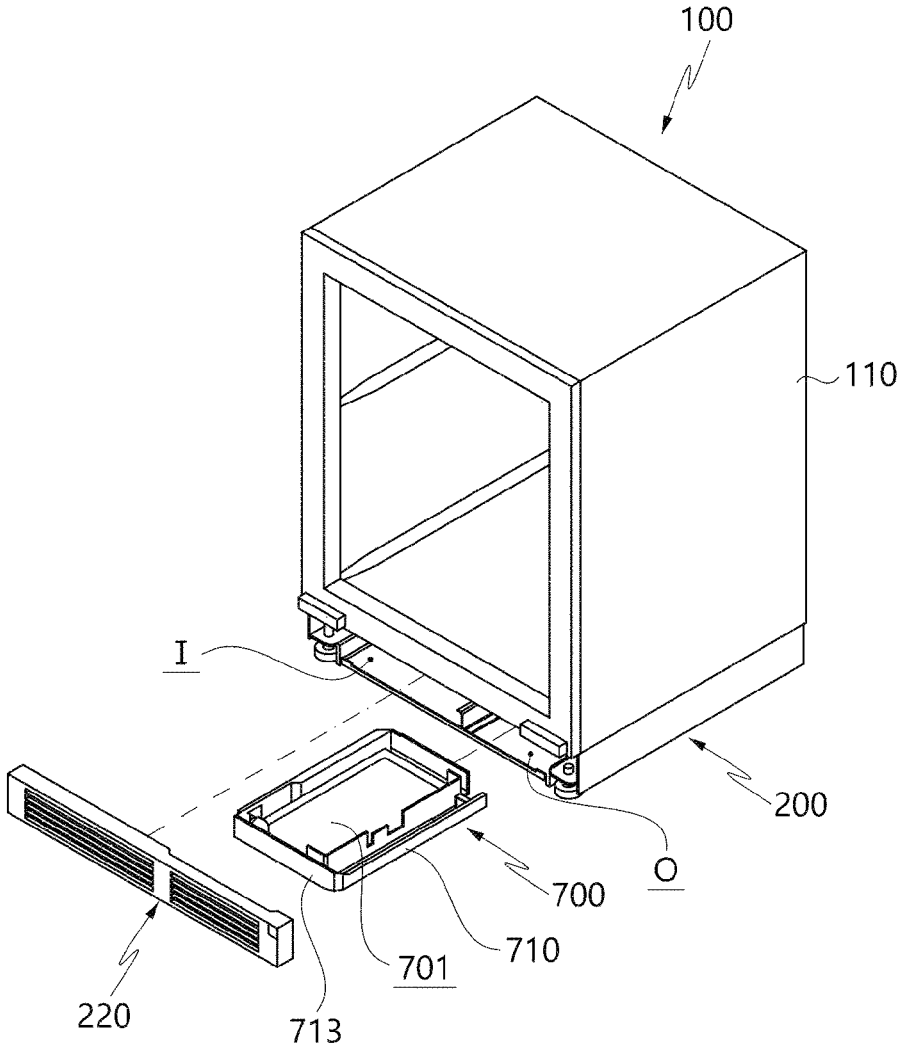
FIG. 10 is a perspective view illustrating a state in which a control module is removed from the refrigerator of the present disclosure.

In FIG. 10, a state in which the control module 700 is completely removed to the outside of the machine room 201 is illustrated. Unlike this, the installation rail 260 may be installed at the side of the inlet in parallel to the open direction of the inlet 225*a*, but is more preferably installed at the side of the outlet 225*b* so as not to prevent the flow of air introduced into the inlet 225*a*.

In the embodiment, the control module 700 may be provided along the first wall 231 constituting the separation wall 230. The first wall 231 may extend in a front-to-rear direction, that is, in the moving in/out direction of the control module 700, and when the control module 700 is installed on the part of the first wall 231, the first wall 231 and the control module 700 may not interfere with each other.

Figure 11:
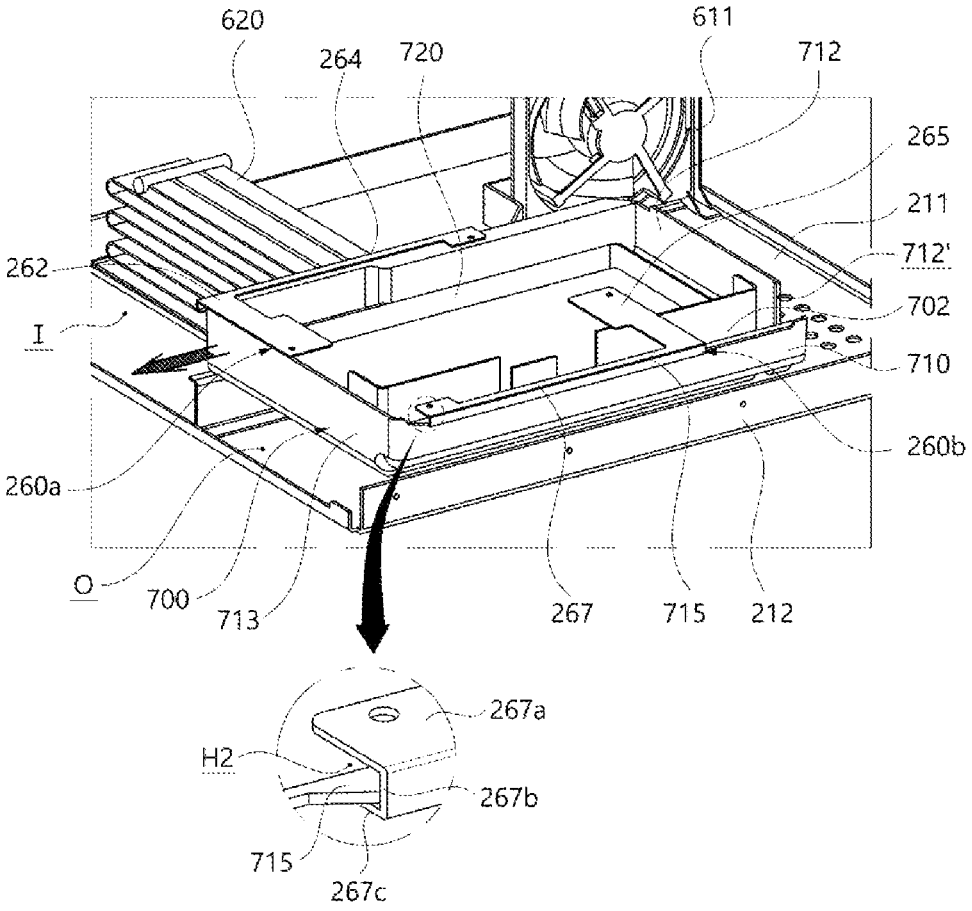
FIG. 11 is a perspective view illustrating a state in which the control module is installed on the machine room module constituting the refrigerator according to the embodiment of the present disclosure.

Looking at FIG. 11, the installation rail 260 may include a pair of installation rails provided by being spaced apart from each other such that the installation rails are coupled to the opposite side surfaces of the control module 700 and extend in parallel to each other. The control module 700 may be assembled slidably between the pair of installation rails 260. Relative to the drawing, in the pair of installation rails 260, a left installation rail 260 is identified as a first rail 260*a*, and a right installation rail 260 is identified as a second rail 260*b*.

In this case, the first rail 260*a* may be installed on the lower surface of the cover plate 250 covering the upper part of the machine room module 200, and the second rail 260*b* may be installed on the lower surface of the cover plate 250 in a direction parallel to the first rail 260*a*. That is, in FIGS. 11 and 12, the first rail 260*a* and the second rail 260*b* are illustrated independently, but in reality, the first rail 260*a* and the second rail 260*b* are installed on the lower surface of the cover plate 250. However, the cover plate 250 is omitted from the drawings such that the first rail 260*a* and the second rail 260*b* are seen clearly.

Looking at the structure of the first rail 260*a*, the first rail 260*a* may include a first fixed frame 262 and a first guide frame 264. The first fixed frame 262 is a part fixed to the lower surface of the cover plate 250 such that the first rail 260*a* can be securely fixed to the cover plate 250. Additionally, a first guide channel H1 to which a portion of the side surface of the control module 700 is fitted may be formed in the first guide frame 264. The first fixed frame 262 and the first guide frame 264 may be connected orthogonally to each other to have an approximate "L" shape. Of course, the first guide frame 264 may also be fixed to the lower surface of the cover plate 250 by a fastener.

Figure 12:
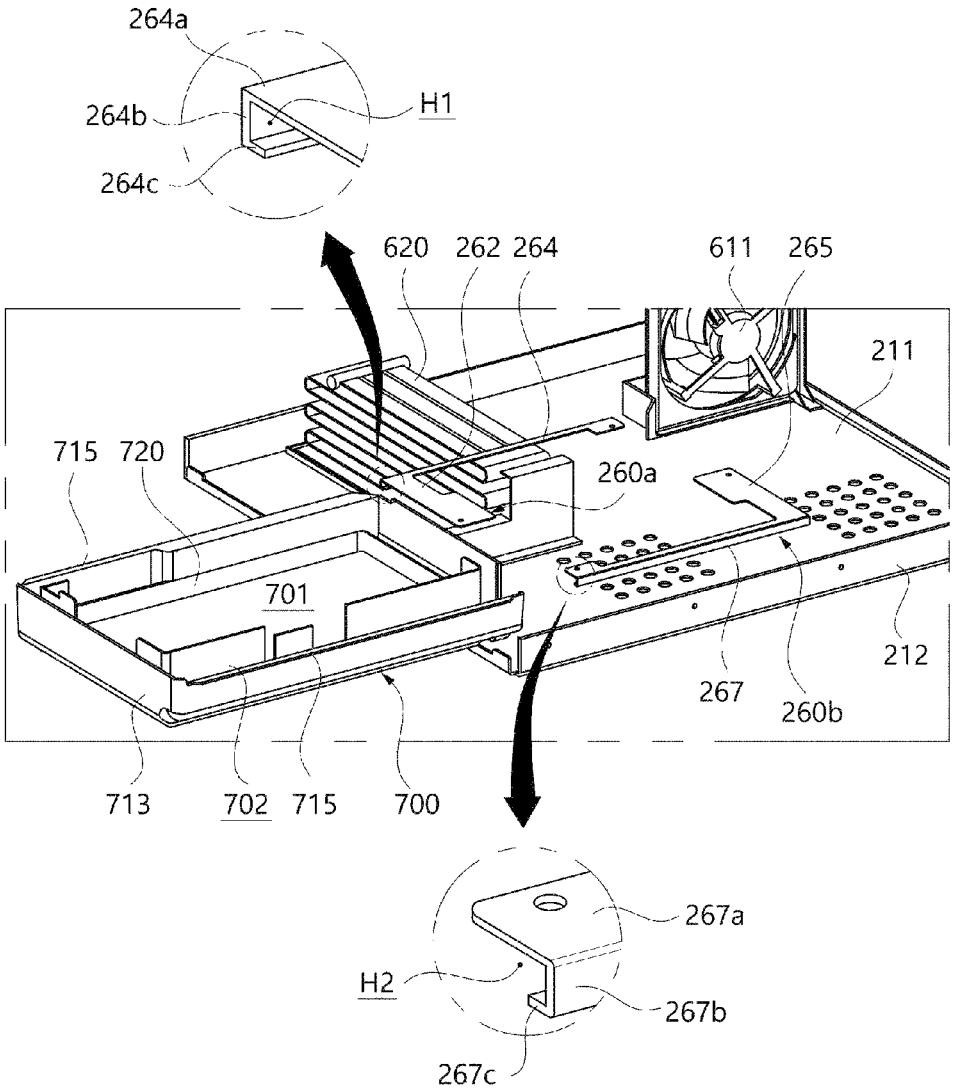
FIG. 12 is a perspective view illustrating a state in which the control module of FIG. 11 is removed to the outside.

Looking at an enlarged part of FIG. 12, the first guide channel H1 is formed in the first guide frame 264. The first guide channel H1 may be open in a front thereof such that an edge of a side surface of a receiving casing 710 constituting the control module 700 can be fitted into the first guide channel. In the first guide frame 264, an upper surface part 264*a*, a side surface part 264*b*, and a lower end fixing part 264*c* are connected to each other to have a "U" shape, and the first guide channel H1 is defined therebetween.

Meanwhile, looking at the structure of the second rail 260*b*, the second rail 260*b* may include a second fixed frame 265 and a second guide frame 267 like the first rail 260*a*. The second fixed frame 265 is a part fixed to the lower surface of the cover plate 250 such that the second rail 260*b* can be securely fixed to the cover plate 250. Furthermore, a second guide channel H2 to which a portion of the side surface of the control module 700 is fitted may be formed in the second guide frame 267. The second fixed frame 265 and the second guide frame 267 may be connected orthogonally to each other to have an approximate "L" shape. Of course, the second guide frame 267 may also be fixed to the lower surface of the cover plate 250 by a fastener.

Looking at the enlarged part of FIG. 11, the second guide channel H2 may be formed in the second guide frame 267. The second guide channel H2 may be formed to face the first guide channel H1 and may be open in a front thereof such that an edge of a side surface of the receiving casing 710 constituting the control module 700 can be fitted into the second guide channel H2. In the second guide frame 267, an upper surface part 267*a*, a side surface part 267*b*, and a lower end fixing part 267*c* are connected to each other to have a "U" shape, and the first guide channel H1 is defined therebetween.

Accordingly, in the embodiment, the installation rails 260 may be configured as two rails separated from each other, and may be assembled independently of each other. Accordingly, errors occurring during the manufacturing process of the installation rails 260 may be compensated to some extent during an installation process thereof.

The first fixed frame 262 and the second fixed frame 265 may be located at complementary positions to each other, so the first rail 260*a* and the second rail 260*b* may form a rectangular shape as a whole. Of course, alternatively, the first rail 260*a* and the second rail 260*b* may be connected to each other, and the installation rail 260 may be configured as one part. Alternatively, at least one of the first rail 260*a* and the second rail 260*b* of the installation rail 260 may be made to be integrated with the lower surface of the cover plate 250.

Looking at the control module 700, the opposite side surfaces of the control module 700 may be assembled slidably with the first rail 260*a* and the second rail 260*b*, respectively. Additionally, as illustrated in FIG. 10, when the front cover 220 of the machine room module 200 is removed from the front surface of the machine room module 200, the front part of the control module 700 may be exposed to the front side of the machine room module 200. In FIG. 2, S indicates a part in which the control module 700 is installed.

Accordingly, in the embodiment, the control module 700 may be installed in the machine room 201, and may be disposed to be adjacent to the front surface of the machine room 201 so as to face the inlet 225*a* or the outlet 225*b*. More precisely, the control module 700 may be installed in the upper part of the machine room 201 adjacent to the outlet 225*b*, and when the control module 700 is installed in the machine room 201, the discharge space O may be defined between the lower surface of the control module 700 and the bottom surface of the machine room module 200. Accordingly, the control module 700 may be installed at a position close to the entrance of the machine room 201 and thus may be removed from the front of the machine room 201.

Particularly, for maintenance of the control module 700, the rear of the refrigerator may not be required to be opened, and the control module 700 may be removed from the front of the refrigerator to be repaired or replaced, and when the machine room module of the present disclosure is applied a built-in refrigerator, the repair or replacement work may be performed in front of the refrigerator without taking the entirety of the refrigerator out of an installation place thereof.

For reference, in the embodiment, the inlet 225*a* may be configured to have an area larger than the area of the outlet 225*b*. Through this, the introduction of outside air may be more efficiently performed.

Figure 15:
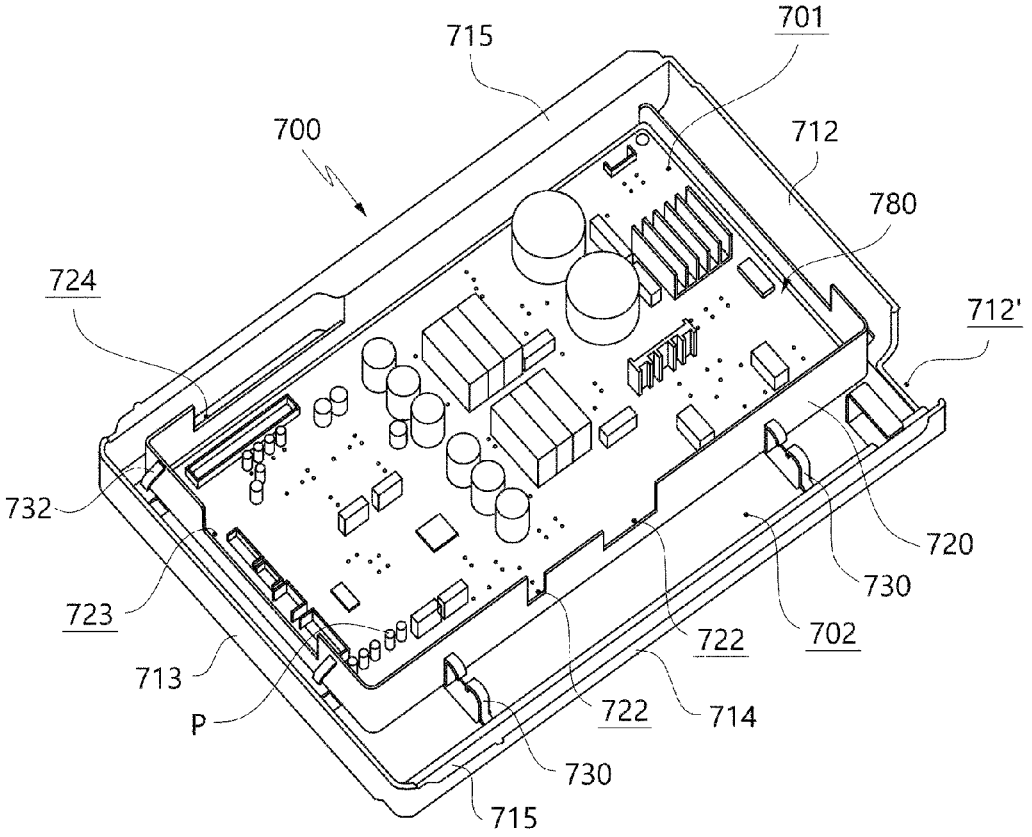
FIG. 15 is a perspective view illustrating a state in which a main circuit board is received in the receiving casing constituting the control module in the embodiment of the present disclosure.

While the control module 700 faces the upper surface of the machine room module 200 corresponding to the ceiling of the machine room 201, that is, the lower surface of the cover plate 250, the control module 700 may be installed parallel to the upper surface of the machine room module 200. In other words, as illustrated in FIG. 15, the control module 700 may be installed inside the machine room 201 while in a lying state. Accordingly, in a horizontal lying state, a main control board 780 constituting the control module 700 may be stored inside the receiving casing 710, which is a kind of drawer structure, and thus may be stably stored therein even if the main control board is not fastened with a separate fastener. Of course, the main control board 780 may be fastened to the receiving casing 710 by using a separate fastener such as a bolt.

Accordingly, since the control module 700 is installed on the cover plate 250 covering the upper part of the machine room 201, vibration generated by a device such as the compressor 610 installed on the bottom surface of the machine room 201 may be prevented from being transmitted directly to the control module 700. In order to enhance such a function, separate damper (not shown) may be installed between the installation rail 260 and the control module 700, or between the installation rail 260 and the cover plate 250.

In addition, since the control module 700 is received in the machine room 201 horizontally by lying in the width direction of the machine room 201 rather than the height direction thereof, at least a left-to-right installation interval of the control module corresponding to the width direction of the outlet 225*b* may be secured. Accordingly, the area of the main control board 780 constituting the control module 700 may be sufficiently increased. Referring to FIG. 8, it can be seen that the control module 700 occupies most of a remaining area except for an installed part of the compressor 610 at the side of the outlet 225*b*.

Figure 13:
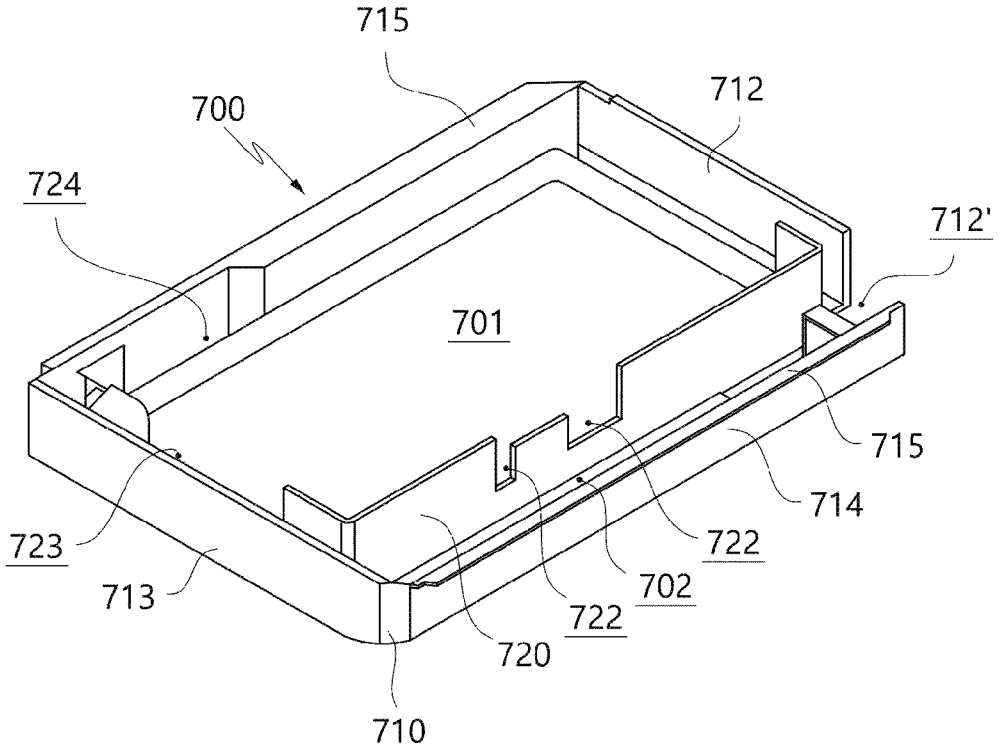
FIG. 13 is a perspective view illustrating the configuration of a receiving casing constituting the control module in the embodiment of the present disclosure.
Figure 14:
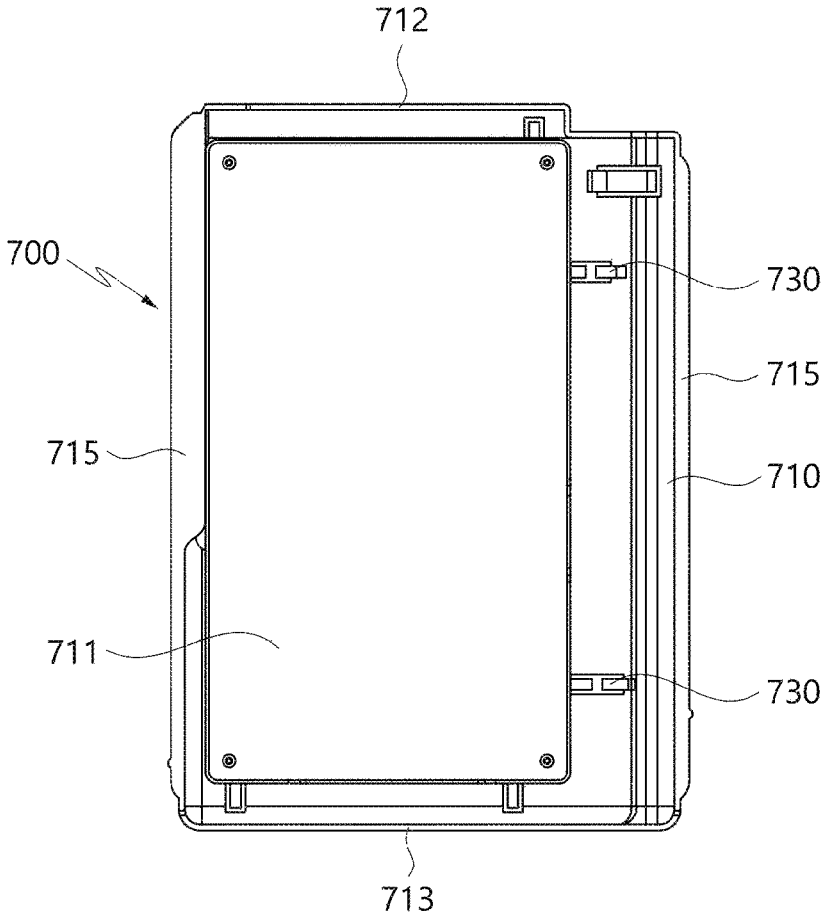
FIG. 14 is a bottom view illustrating the configuration of the lower surface of the receiving casing constituting the control module in the embodiment of the present disclosure.

As for the detailed structure of such a control module 700, the control module 700 may include the receiving casing 710 and the main control board 780. The receiving casing 710 may be assembled removably with the upper part of the machine room 201, that is, with the installation rail 260, and may have a receiving space 701 in the center of the receiving casing 710. Referring to FIGS. 13 and 14, the receiving casing 710 may have an approximately rectangular frame structure and be open upward such that the receiving space 701 is exposed.

The receiving casing 710 may have a width smaller than or equal to the width of the outlet 225*b* such that the receiving casing 710 can be moved inside and outside of the outlet 225*b*. In addition, to avoid excessively reducing the height of the outlet 225*b*, it is preferable that the receiving casing 710 has height less than a half of the height of the outlet 225*b* which is removed.

In the embodiment, the control module 700 may be configured to have vertical height smaller than the overall height of the discharge space O of the machine room 201, and thus the discharge space O may be defined between the lower surface of the control module 700 and the bottom surface of the machine room 201.

Referring to FIG. 14, the receiving casing 710 may be provided with a protection wall 712, 713, and 714. The protection wall 712, 713, and 714 may protrude along the edge of the receiving casing 710 so as to cover the receiving space 701, and the height of the protection wall 712, 713, and 714 may be the height of the receiving casing 710.

The protection wall 712, 713, and 714 may include a rear wall 712 directed toward the inside of the machine room 201 and a front wall 713 directed toward the outside of the machine room, and a guide end 715 may be provided along each of side walls 714 constituting the side surfaces of the machine room. The guide end 715 may be a part assembled with the installation rail 260 and may extend long along the side wall 714 of the receiving casing 710 such that the guide end 715 is fitted to each of the first guide channel H1 and the second guide channel H2 of the installation rail 260.

Of course, a structure in which the receiving casing 710 is assembled inside the machine room 201 is not necessarily limited to this structure. For example, the receiving casing 710 may not be assembled with the machine room 201 by sliding in a front-to-rear direction relative to the front surface of the machine room 201, but a fixing structure in which after the receiving casing 710 is inserted into the machine room 201, the receiving casing 710 may be pushed in a direction orthogonal to an inserting direction of the receiving casing 710 to be fixed may be applied to the machine room 201.

The guide end 715 may be provided on an upper end of the side wall 714 of the receiving casing 710 closest to the lower surface of the cover plate 250 covering the machine room 201. That is, the guide end 715 may be provided along the upper end of the side wall 714 of the receiving casing 710, and may protrude outward from the upper end of the side wall 714. Since the guide end 715 is provided on the upper end of the side wall 714, the receiving casing 710 may be installed to be in close contact with the lower surface of the cover plate 250. In this case, without a separate cover, the upper surface of the receiving space 701 may be covered by the cover plate 250, and introduction of foreign matter into the receiving space 701 may be prevented.

A partition wall 720 may be provided inside the protection wall 712, 713, and 714 of the receiving casing 710. The receiving space 701 in which the main control board 780 is received may be defined in the center of the receiving casing 710 of the control module 700, and the partition wall 720 may partition the receiving space 701. More precisely, the partition wall 720 may define a wire connection space 702 outside of the receiving space 701 by surrounding the receiving space 701. That is, the wire connection space 702 may be defined between the partition wall 720 and the protection wall 712, 713, and 714.

The wire harness connected to the main control board 780 may be seated on the wire connection space 702. The wire connection space 702 may be space independent of the receiving space 701, and thus the wire harness may be easily organized therein.

Particularly, inside the small machine room 201, multiple strands of wire harnesses may be twisted or interfere with peripheral parts including a part P of the main control board 780, but may be organized through the wire connection space 702. In the embodiment, the wire connection space 702 may have an approximately "L"-shaped path, and alternatively, the wire connection space 702 may be defined so as to surround the entirety of the outside of the receiving space 701.

Accordingly, the partition wall 720, together with the protection wall 712, 713, and 714 may act as a kind of double wall. Accordingly, the partition wall 720 may filer out foreign matter being introduced into the main control board 780.

In this case, at least one through groove 722, 723, or 724 may be formed in the partition wall 720, and through the through groove 722, 723, or 724, the receiving space 701 and the wire connection space 702 may be connected to each other. The wire harnesses on the main control board 780 installed in the receiving space 701 may branch through a connector, and may pass through the through groove 722, 723, or 724 into the wire connection space 702. In the embodiment, the through groove 722, 723, or 724 may include multiple through grooves formed along the partition wall 720.

Referring to FIG. 15, a hooking part 730 may protrude on the bottom or side surface of the wire connection space 702. The hooking part 730 may hook and hold the wire harness disposed in the wire connection space 702, and may include multiple hooking parts provided along the wire connection space 702. The hooking part 730 may have a hook structure which is elastically transformed and restored in the process of hooking the wire harness so as to prevent the wire harness from being removed therefrom. Of course, alternatively, the hooking part 730 may have a structure protruding simply or may be a hole into which a portion of the wire harness is fitted.

A connection hole 712' may be formed through the rear of the receiving casing 710 of the control module 700 directed toward the inside of the machine room 201. The connection hole 712' may allow a portion of the wire harnesses connected to the control module 700 to extend to the outside of the receiving casing 710. In the embodiment, the connection hole 712' may be formed through the rear of the wire connection space 702.

Next, the operation of the refrigerator according to the embodiment of the present disclosure will be described in more detail.

First, when the door assembly 130 is closed with food stored in the storage space 121, the storage space 121 is a sealed space. In this state, when the operation of the air conditioning module 600 starts, the temperature control function of the refrigerator starts. That is, the heat dissipation fan 611, the compressor 610, the main condenser 620, and the evaporator 630 constituting the air conditioning module 600 may operate and perform an air conditioning operation.

Particularly, when such an air conditioning operation is performed, indoor air may be introduced through the inlet 225*a* of the front cover 220 installed on the open front surface of the machine room 201 into the machine room 201 and air passing through the inside of the machine room 201 may be discharged through the outlet 225*b* of the front cover 220. In this case, indoor air introduced into the inlet 225*a* may pass consecutively through the main condenser 620, the heat dissipation fan 611, and the compressor 610 to perform heat exchange and heat dissipation and then may be discharged through the outlet 225*b* to an indoor space.

In this case, in the operation process of the air conditioning module 600, water may be generated in the machine room 201. Defrost water generated from the evaporator 630 may fall and accumulate in the defrost water tray 240. The defrost water accumulated in the defrost water tray 240 may be naturally evaporated by the evaporation tube L2 disposed in the defrost water tray 240.

In addition, when the air conditioning module 600 operates, a refrigerant may flow consecutively through the compressor 610, the main condenser 620, the first side condensing tube L4, the second side condensing tube L6, the front condensing tube L8, the dryer, the main control valve 625, the capillary tube, the evaporator 630*a* and 630*b*, and the compressor 610, and the cooled evaporator 630*a* and 630*b* may lower the temperature of the storage space 121.

In this case, the first side condensing tube L4, the second side condensing tube L6, and the front condensing tube L8 may perform the function of the condenser and may be mounted inside the surface of the cabinet 100, and thus may prevent dew from being formed on the surface of the cabinet 100.

Meanwhile, the operation of such an air conditioning module 600, and the display module 800 for manipulating the air conditioning module 600 may be controlled by the control module 700, and the control module 700 may be installed inside the front surface of the machine room 201 and may be easily maintained.

The process of maintaining the control module 700 will be described in detail. When an operator first removes the front cover 220 assembled with the front surface of the machine room module 200, the front surface of the machine room 201 is exposed. More precisely, as illustrated in FIG. 11, the entrance of the introduction space I and the exit of the discharge space O may be exposed to the entrance of the front surface of the machine room module 200.

In this case, the control module 700 may be exposed to the upper part of the entrance of the discharge space O. The control module 700 may be installed in the upper part of the discharge space O of the machine room 201, that is, on the lower surface of the cover plate 250, and the front wall 713 of the receiving casing 710 of the control module 700 directed to the outside may be exposed to the outside to be checked with a naked eye.

Accordingly, when an operator pulls out the receiving casing 710 by holding a surface of the front wall 713, the receiving casing 710 may be moved out while sliding in a rectilinear direction along the installation rail 260. As illustrated in FIG. 12, when the guide end 715 of the receiving casing 710 is completely from each of the first guide channel H1 and the second guide channel H2 of the installation rail 260, the receiving casing 710 may freely move to the outside of the machine room 201.

In this case, the receiving space 701 of the receiving casing 710 may be initially covered by the lower surface of the cover plate 250, but when the control module 700 is moved outside, the receiving space 701 may be open upward. When the receiving space 701 is open upward, the main control board 780 received in the receiving space 701 may be immediately exposed to the outside and be in a state in which the main control board 780 can be taken out.

Particularly, the main control board 780 is in a lying state in the receiving space 701, so an operator may check the state of the main control board 780 with the naked eye at the same time at which the main control board 780 is taken out. Accordingly, in this state, after disconnecting a wire harness and a connector from the main control board 780, an operator may easily take out the main control board 780 from the receiving space 701.

After an operator repairs or replaces the main control board 780, the operator may reconnect the wire harness and the connector to the main control board 780 and may seat the main control board in the receiving space 701. In this case, the wire harness may be organized in the wire connection space 702.

Finally, when an operator pushes the receiving casing 710 in a direction opposite to the direction of pulling out the receiving casing 710, that is, to the inside of the machine room, the control module 700 may be restored to an initial position thereof. Accordingly, in the present disclosure, the control module 700 may be installed at a position close to the discharge space O of the machine room 201 and may be removed from the front of the machine room 201, so for the maintenance of the control module 700, the rear of the machine room module may not be required to be opened, and the control module 700 may be removed from the front of the refrigerator to be repaired or replaced.

Figure 16:
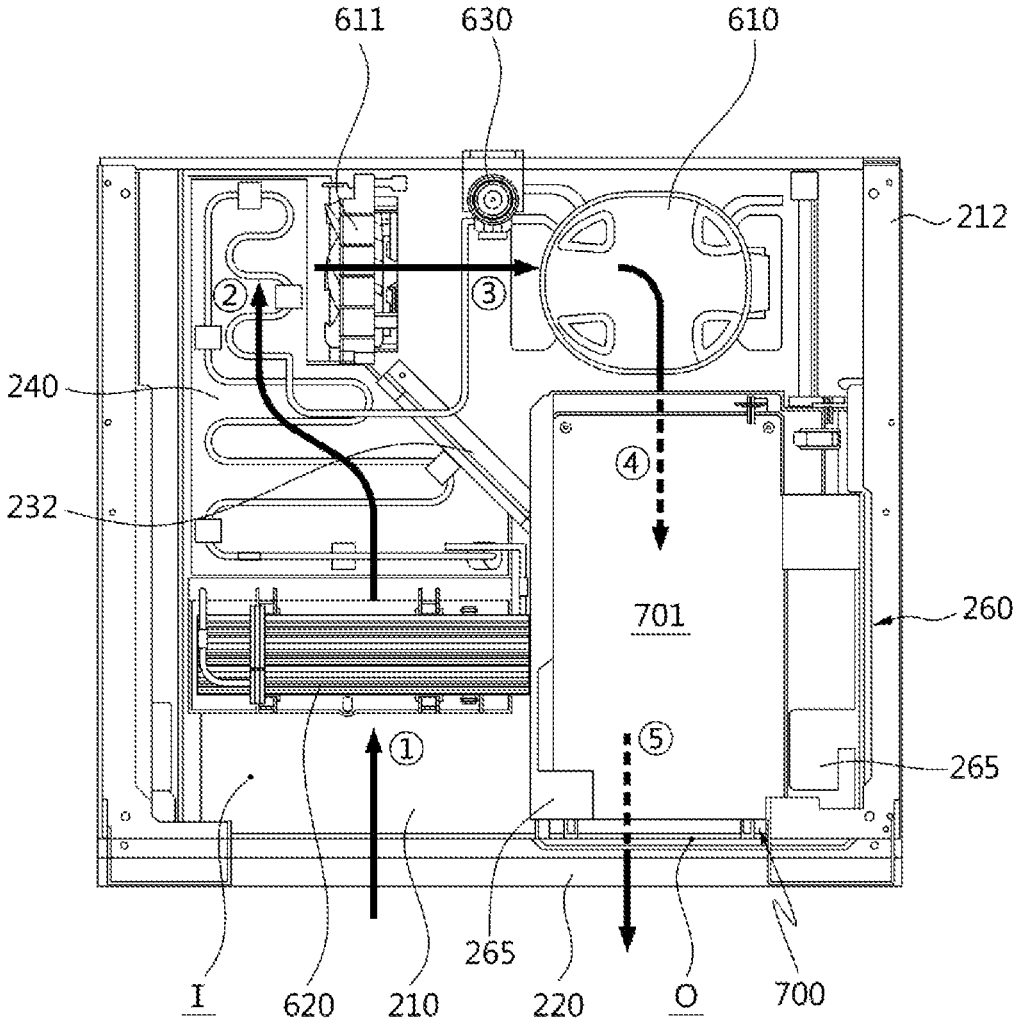
FIG. 16 is a conceptual diagram illustrating an air flow state inside the machine room module constituting the refrigerator according to the embodiment of the present disclosure.

FIG. 16 is a view illustrating an air flow state inside the machine room 201. As illustrated in the drawing, during the operation of the refrigerator 1, the temperature of the machine room 201 increases. Particularly, the temperature of the machine room 201 may rise. Particularly, the temperatures of the compressor 610 and the condenser 620 may greatly rise, and in the embodiment, this temperature rise may be suppressed through an air flow inside the machine room 201.

More specifically, first, when the heat dissipation fan 611 operates, the heat dissipation fan 611 may introduce outside air into the introduction space. Here, when air of the outside (a place in which the refrigerator is installed) is introduced through the front cover 220 into the introduction space I (the direction of arrow ①), the air may immediately meet the condenser 620. Particularly, in the embodiment, the entrance of the introduction space I may be wider than the exit of the discharge space O. That is, the entrance of the introduction space I may be widened to increase the amount of air introduced initially, and accordingly, the condenser 620 may be effectively cooled.

In addition, the introduced air may evaporate a portion of defrost water while passing over the defrost water tray 240 (the direction of arrow ②). In this case, the introduced air may be guided by the separation wall 230. That is, the introduced air may not flow to the discharge space O including the compressor 610, but may be guided to the heat dissipation fan 611 along the separation wall 230. In this case, the heat dissipation fan 611 may be installed on the rear end portion of the separation wall 230, and the heat dissipation fan 611 may be a part of a kind of separation wall 230.

After the introduced air passes through the heat dissipation fan 611 (the direction of arrow CD), the air may be discharged to the compressor 610 facing the heat dissipation fan 611 and may cool the compressor 610. Since the heat dissipation fan 611 is open, the introduction space I and the discharge space O may be connected to each other relative to the heat dissipation fan 611, but when the heat dissipation fan 611 operates, air may flow from the introduction space I to the discharge space O, so it is difficult that the air flows in a direction opposite to the direction of the air flow. Accordingly, the heat of the compressor 610 may be effectively prevented from being transferred to the condenser 620.

Air passing through the compressor 610 may pass through the discharge space O (the direction of arrow ④). In this case, since the control module 700 is located the upper side of the discharge space O, the discharge space O may be defined between the lower surface of the control module 700 and the bottom surface of the machine room module 200, and the air passing through the compressor may pass through this part. In FIG. 39, a part in which air passes through the lower side of the control module 700 is indicated by a dotted line.

Finally, air which completes cooling is discharged to the outside through one side of a grille part 225 in contact with the exit of the discharge space O (the direction of an arrow ⑤). Accordingly, in the embodiment, introduced air may flow only along a predetermined path, so it is possible to perform effective cooling.

Particularly, the control module 700 may be disposed to be long and wide on the upper surface of the discharge space O and thus may be effectively cooled by air passing through space between the control module 700 and the bottom of the machine room 201.

Next, another embodiment of the present disclosure will be described with reference to FIGS. 17 to 22. For reference, the same reference numerals are given to the same structures as in the previous embodiment, and detailed descriptions thereof are omitted, and the control module 1700 will be mainly described.

Figure 17:
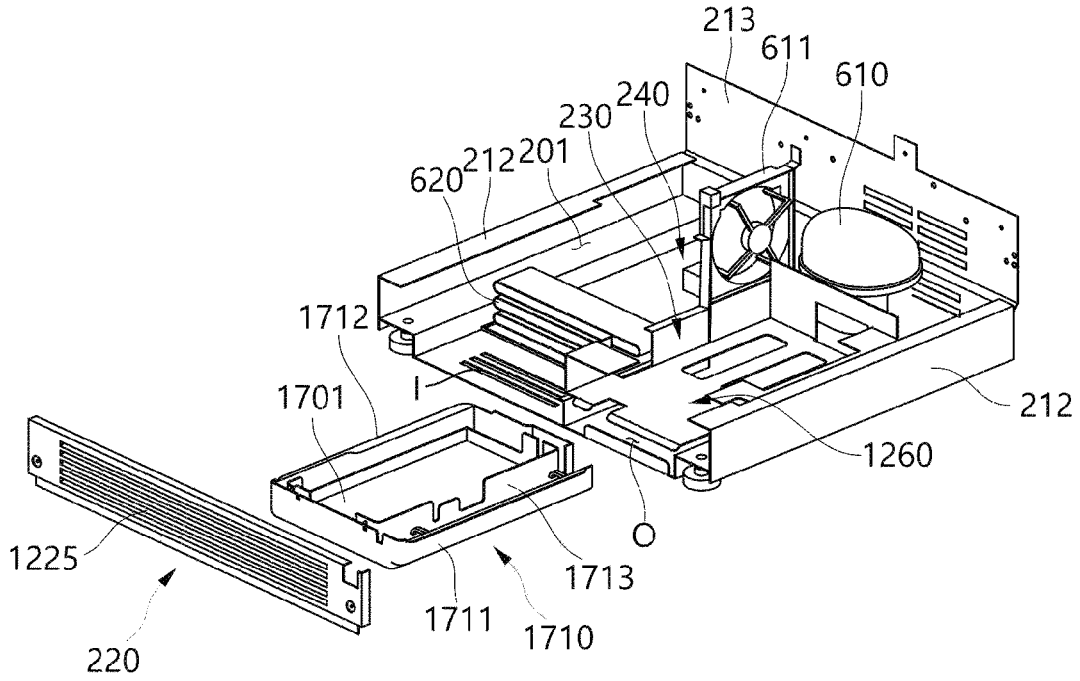
FIG. 17 is an exploded perspective view illustrating a state in which a front cover of a machine room and the control module are separated from each other in the refrigerator according to another embodiment of the present disclosure.

FIG. 17 is an exploded perspective view illustrating a state in which the front cover of the machine room and the control module are separated from each other. As illustrated in the drawing, the machine room 201, that is, the front surface of the machine room module 200 may be open, and the open front surface of the machine room module 200 may be covered by the front cover 220.

When the front cover 220 is opened, the open entire surface of the machine room module 200 may be open, and the inside of the machine room may be exposed to the outside through the front surface of the machine room 201. For reference, unlike the previous embodiment, the grille part 1225 connected overall may be formed on the front cover 220. The grille part 1225 may include multiple openings passing through the front cover 220, and may allow air to be introduced into the machine room 201 and may allow the internal air of the machine room 201 to be discharged to the outside.

In this case, at the side of the discharge space O of the machine room 201, a control module 1700 may be exposed to the outside. Accordingly, efficient access to the control module 1700 may be performed by removing the front cover 220. Particularly, due to the structure of a receiving casing 1710 and a casing guide 1260 constituting the control module 1700, the receiving casing 1710 may be moved outside of the machine room 201. Accordingly, after opening the front surface of the machine room 201, a user may pull only the receiving casing 1710 for the maintenance of the control module 1700.

To this end, the casing guide 1260 may be received in the machine room 201. The casing guide 1260 may be disposed at the exit side of the discharge space O, and may have a width corresponding to the horizontal width of the discharge space O. Additionally, the casing guide 1260 may have a length extending from the front side of the compressor 610 to the front end of the discharge space O. In this case, the lower surface of the casing guide 1260 may be spaced apart from the bottom surface of the machine room 201 such that space to allow air passing through the discharge space O to pass is provided.

In addition, the casing guide 1260 may be mounted to the lower surface of the cover plate 250, and may be disposed inside the machine room 201 when the cabinet 100 and the machine room module 200 are coupled to each other.

A predetermined space may be defined between the lower surface of the casing guide 1260 and the upper surface of the cover plate 250, and the receiving casing 1710 may be inserted and mounted in the predetermined space. That is, the control module 1700 may be mounted to the lower surface of the cabinet 100 by hanging therefrom, and may be located inside the machine room 201 when the cabinet 100 and the machine room 201 are coupled to each other.

Furthermore, the casing guide 1260 may be configured to be open in a front surface thereof, and the open front surface of the casing guide 1260 may be located at a position corresponding to the open front surface of the discharge space O. Accordingly, with the front cover 220 mounted, the control module 1700 may be covered, and when the front cover 220 is removed, the control module 1700 may be exposed to the outside.

Hereinafter, the detailed structure of the control module 1700 will be described in more detail with reference to the accompanying drawings.

Figure 18:
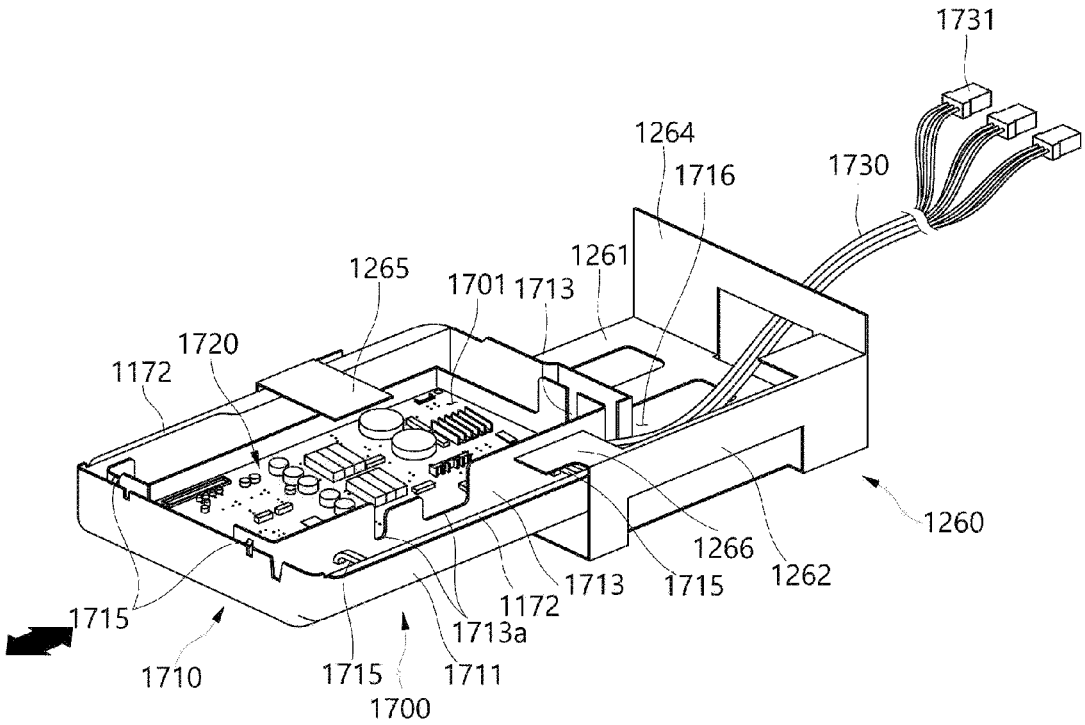
FIG. 18 is a perspective view illustrating the mounted state of the receiving casing of the control module constituting the refrigerator according to the embodiment illustrated in FIG. 17.
Figure 19:
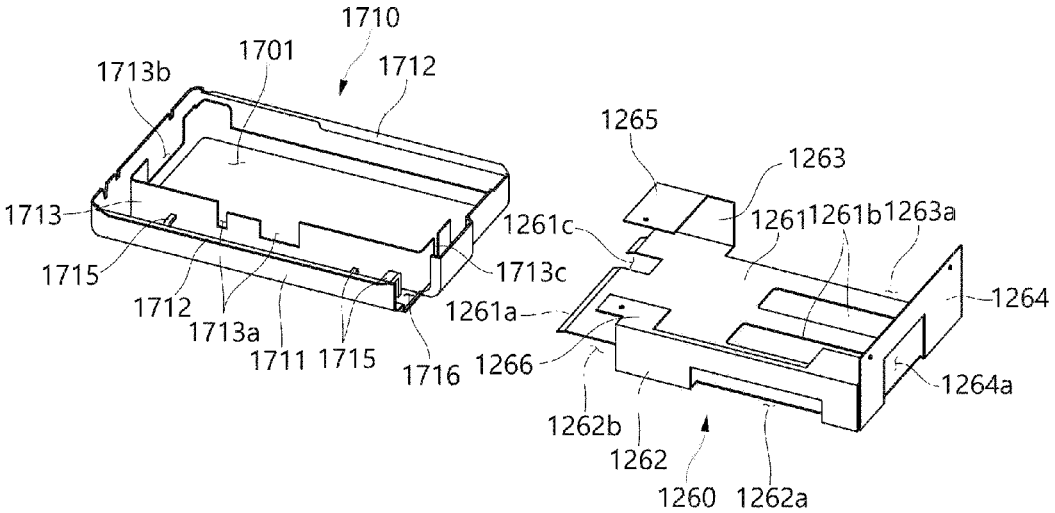
FIG. 19 is an exploded perspective view of the receiving casing and a mounting guide constituting the refrigerator according to the embodiment illustrated in FIG. 17.

FIG. 18 is a perspective view illustrating the mounted state of the receiving casing of the control module. Additionally, FIG. 19 is an exploded perspective view of the receiving casing and a mounting guide.

As illustrated in the drawings, the control module 1700 may include the receiving casing 1710, a main control board 1720 disposed inside the receiving casing 1710 and configured to control the overall operation of the refrigerator 1, and the casing guide 1260 to which the receiving casing 1710 is mounted.

The receiving casing 1710 may be configured to have a box shape having an open upper surface, and a peripheral surface of receiving casing 1710 may be configured to have height equal to or slightly lower than the vertical width of the casing guide 1260.

The receiving casing 1710 may be formed of a plastic material and may have a flat shape which is long in width and length and is low in height. That is, the receiving casing 1710 allows the main control board 1720 to be disposed as wide and large as possible and allows the wire harness 1730 to be disposed along a side thereof such that the arrangement space of the main control board 1720 is secured and the flow of air to the discharge space is not obstructed.

Meanwhile, an inner edge 1713 may be formed inside the receiving casing 1710. The inner edge 1713 may extend upward from the bottom of the inner surface of the receiving casing 1710, and may be configured along periphery of the main control board 1720. Accordingly, a PCB receiving part 1701 to which the main control board 1720 can be mounted may be formed inside the inner edge 1713. With the main control board 1720 mounted inside the PCB receiving part 1701, the main control board 1720 may maintain a position thereof by being in contact with the inner edge 1713. Of course, the main control board 1720 may maintain a state fixed inside the receiving casing 1710 by screwing or hooking.

In addition, space spaced apart from the peripheral surface 1711 of the receiving casing 1710 may be defined outside the inner edge 1713. Space to allow the wire harnesses 1730 connected to the main control board 1720 to be guided rearward may be defined in the space defined between the inner edge 1713 and the peripheral surface 1711 of the receiving casing 1710.

Furthermore, a guide part 1712 may be formed on the upper end of the peripheral surface 1711 of the receiving casing 1710 by protruding outward therefrom. The guide part 1712 may be a part in contact with the inner side surface of each of a first side surface part 1262 and a second side surface part 1263 which are the opposite side surfaces of the casing guide 1260. When the receiving casing 1710 is moved in/out, the guide part 1712 may be in linear contact with each of the first side surface part 1262 and the second side surface part 1263 such that the receiving casing 1710 can be efficiently moved in/out.

Additionally, multiple cut wire passing parts 1713*a*, 1713*b*, and 1713*c* may be formed in the inner edge 1713. Accordingly, the wire harnesses 1730 connected to the main control board 1720 may pass through the inner edge 1713 and may be guided to space between the inner edge 1713 and the peripheral surface 1711 of the receiving casing 1710. The wire passing parts 1713*a*, 1713*b*, and 1713*c* may be formed at positions corresponding to positions at which the wire harnesses 1730 are connected to the main control board 1720, and may include multiple wire passing parts.

In addition, a wire hooking part 1715 may be formed in the space between the inner edge 1713 and the peripheral surface 1711 of the receiving casing 1710. The wire hooking part 1715 may be formed in a hook shape and may prevent the wire harnesses 1730 guided to the space between the inner edge 1713 and the peripheral surface of the receiving casing 1710 from being removed therefrom such that the wire harnesses 1730 are maintained to be fixed in the space. Particularly, even in the process in which the receiving casing 1710 is moved in and out, the wire harnesses 1730 may be maintained to be fixed inside the receiving casing 1710 and thus may not interfere with the cover plate 250 or the casing guide 1260.

In addition, a casing exit 1716 may be formed in the rear surface of the receiving casing 1710 such that the wire harnesses 1730 are guided to the outside of the receiving casing 1710. The casing exit 1716 may be formed at a position at which the casing exit 1716 faces a guide exit 1264*a* of the rear surface of the casing guide 1260. Accordingly, the wire harnesses 1730 guided to the outside of the receiving casing 1710 may pass through the casing guide 1260 and may be guided to a harness cover 1290.

The casing guide 1260 may be formed of a metal plate-shaped material, and may be configured to bend multiple times so as to cover the opposite side surfaces and lower surface of the receiving casing 1710. Additionally, the casing guide 1260 may be open in a front surface thereof such that the receiving casing 1710 received in the casing guide 1260 can be moved outside forward. Furthermore, the casing guide 1260 may be fixedly mounted to the lower surface of the cover plate 250.

The casing guide 1260 will be described in more detail. The casing guide 1260 may include a lower surface part 1261, the first side surface part 1262, the second side surface part 1263, a rear surface part 1264, and an upper surface part 1265 and 1266.

The lower surface part 1261 may be formed in a rectangular plate shape, and may be configured to correspond to or to be slightly larger than the size of the lower surface of the receiving casing 1710 and may support the receiving casing 1710 from a lower side thereof. Additionally, a lower surface opening 1261*b* may be formed in the lower surface part 1261 such that the receiving casing 1710 is exposed to the lower side of the casing guide 1260. Accordingly, air passing through the discharge space O may be in direct contact with the lower surface of the receiving casing 1710 and may cool the receiving casing 1710 and the main control board 1720 mounted to the receiving casing 1710.

An entrance inclined surface 1261*a* may be formed on the front end of the lower surface part 1261. The entrance inclined surface 1261*a* may be configured to have an inclination decreasing gradually as the entrance inclined surface 1261*a* extends forward. Accordingly, when moving the receiving casing 1710 inside, the entrance inclined surface 1261*a* may be in contact with the rear surface and lower end of the receiving casing 1710, and may guide the efficient moving of the receiving casing 1710 into the casing guide 1260.

In addition, a front end cut part 1261*c* may be formed on one side of the front end of the lower surface part 1261. The front end cut part 1261*c* may be cut in a shape recessed by a predetermined length rearward. Accordingly, with the receiving casing 1710 received inside the casing guide 1260, the front half part of the lower surface of the receiving casing 1710 may be exposed through the front end cut part 1261*c* to the outside. When moving the receiving casing 1710 in the received state outside the casing guide 1260, a user may hold and pull a side of the receiving casing 1710 exposed through the front end cut part 1261*c*.

In addition, the first side surface part 1262 and the second side surface part 1263 may be formed on the left and right ends of the lower surface part 1261, respectively. The first side surface part 1262 and the second side surface part 1263 may be formed by bending vertically upward from the opposite sides of the lower surface part 1261. The first side surface part 1262 and the second side surface part 1263 may be configured to have heights equal to or slightly larger than the height of the receiving casing 1710 such that the receiving casing 1710 can be efficiently moved in and out of the casing guide 1260.

The first side surface part 1262 may extend from the rear end of the lower surface part 1261 to the front half part thereof. Additionally, the first side surface part 1262 may have a side surface opening 1262*a* and 1262*b* such that the side surface of the receiving casing 1710 can be exposed to the outside.

The second side surface part 1263 may extend upward from a side end of the lower surface part 1261, and may extend from the front end of the lower surface part 1261 only to a side of the front half part thereof. Additionally, a side surface cut prat 1263*a* may be formed in the rear portion of the second side surface part 1263. Accordingly, the second side surface part 1263 may function to restrain one side of the receiving casing 1710, and the outer side surface of the receiving casing 1710 may be exposed to the inside of the machine room 201, so more effective cooling may be performed.

The upper surface part 1265 and 1266 is intended to fixedly mount the casing guide 1260, and may include a first upper surface part 1266 bending from the first side surface part 1262, and a second upper surface part 1265 bending from the second side surface part 1263. The first upper surface part 1266 and the second upper surface part 1265 may be spaced apart from each other and may be coupled to the lower surface of the cover plate 250.

The rear surface part 1264 may be formed on the rear end of the lower surface part 1261 by bending upward therefrom, and may support the rear surface of the receiving casing 1710 so as to limit the insertion position of the receiving casing 1710. Additionally, the guide exit 1264*a* may be formed in the rear surface part 1264 such that each of the wire harnesses 1730 is moved rearward to the outside.

Meanwhile, the wire harness 1730 guided through the guide exit 1264*a* may be configured to have sufficient length, and accordingly, a connection state thereof may be maintained even when the receiving casing 1710 is moved inside/outside.

Hereinafter, the connection structure of the wire harness 1730 will be described in more detail with reference to the accompanying drawings.

Figure 20:
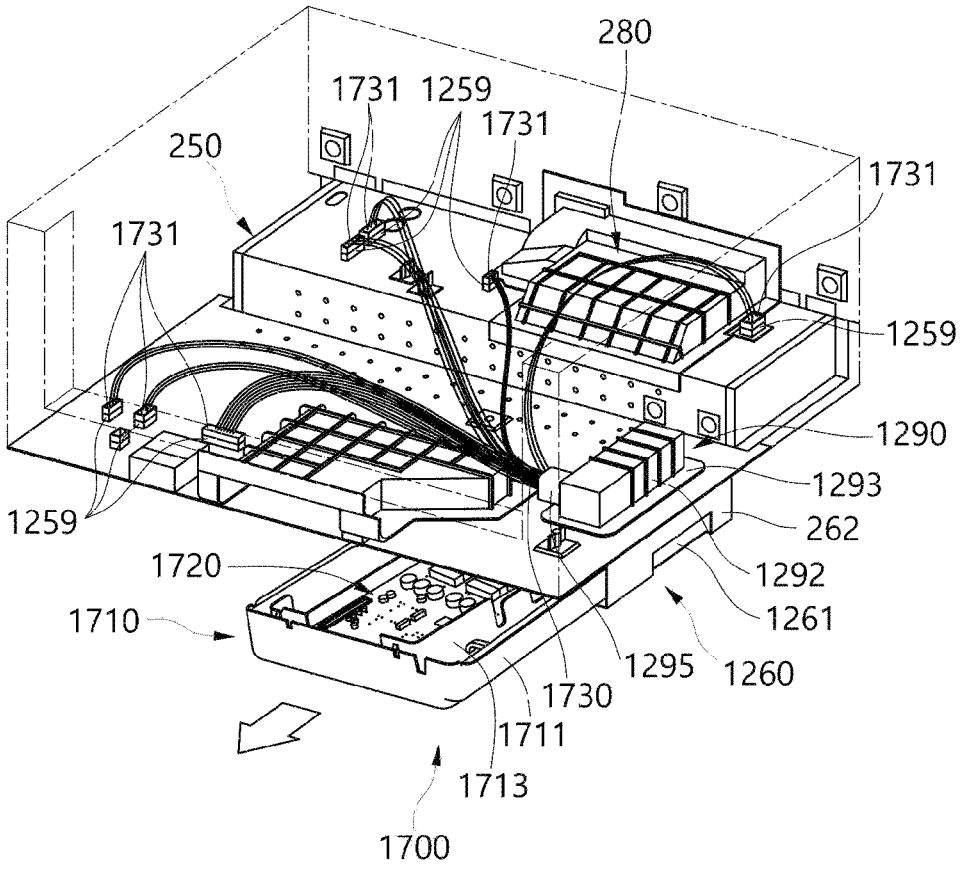
FIG. 20 is a partial perspective view illustrating a wire connection structure on the upper surface of the machine room in the embodiment illustrated in FIG. 17.
Figure 21:
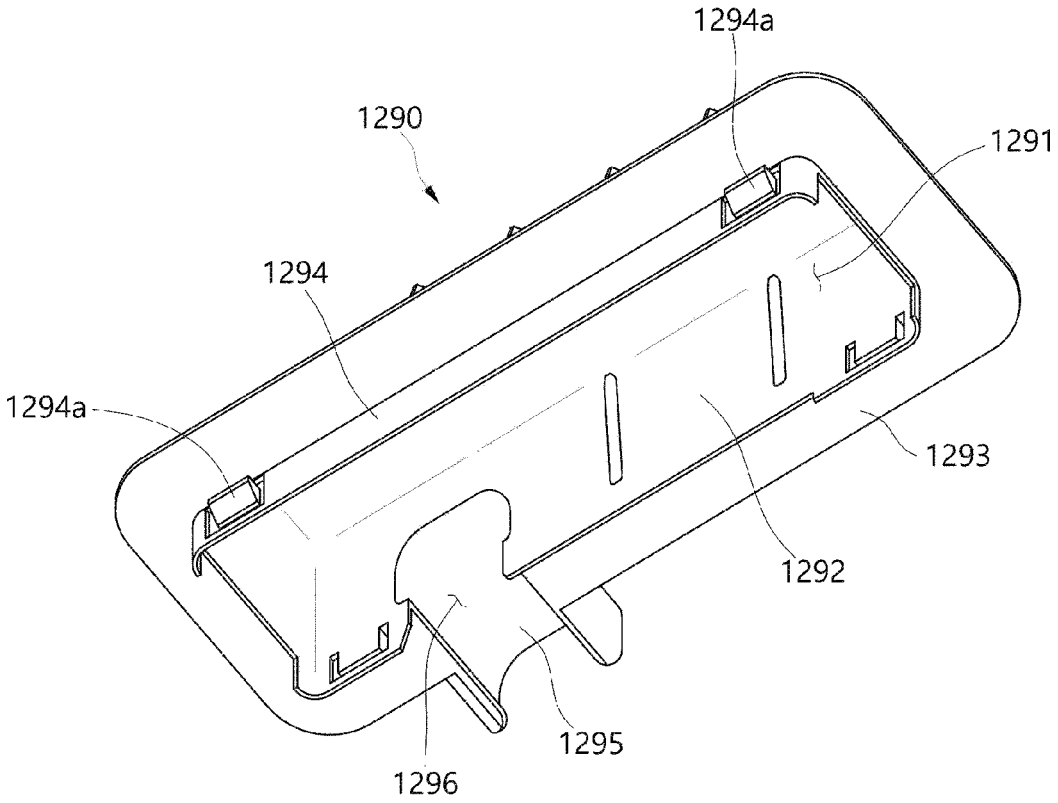
FIG. 21 is a bottom perspective view of a harness cover constituting the refrigerator according to the embodiment illustrated in FIG. 17.

FIG. 20 is a partial perspective view illustrating a wire connection structure on the upper surface of the machine room. Additionally, FIG. 21 is a bottom perspective view of the harness cover according to the embodiment of the present disclosure.

As illustrated in the drawing, the wire harness 1730 guided from the receiving casing 1710 may pass through the cover plate 250 from the inside of the machine room 201 and may be guided upward. In this case, the wire harness 1730 may pass through the harness cover 1290 mounted to the cover plate 250 to be guided.

In detail, the harness cover 1290 may be mounted at a position of the cover plate 250 corresponding to the rear end of the receiving casing 1710. The harness cover 1290 is intended to guide the wire harness 1730 of the inside of the machine room 201 to the upper side of the cover plate 250 and may be injection-molded with a plastic material.

The harness cover 1290 may be configured to be open in a lower surface thereof and may be mounted to the opening of the cover plate 250 to cover the opening thereof. Additionally, a harness cover outlet 1296 may be formed in one side of the harness cover 1290, and the wire harness 1730 guided into the harness cover 1290 may be guided to the outside of the harness cover 1290 from the upper side of the cover plate 250.

The harness cover 1290 may include a cover body 1292 having an open lower surface and a recessed harness receiving space 1291, and a cover edge 1293 formed along the periphery of the cover body 1292. The cover edge 1293 may be formed along the periphery of the perforated opening of the cover plate 250.

The cover body 1292 may protrude upward from the outer side surface of the cover plate 250, and a grid-shaped reinforcing rib may be formed on the outer side surface and may prevent the harness cover 1290 from being deformed by pressure generated when filling foaming liquid to form an insulation material inside the cabinet 100.

In addition, the cover body 1292 may be formed long in a front-to-rear direction. Accordingly, the inner harness receiving space 1291 may also be formed long in the front-to-rear direction and may receive the wire harness 1730 having a sufficient length required when pulling out the receiving casing 1710. That is, in a completely inserted state of the receiving casing 1710, the wire harness 1730 may be received inside the harness receiving space 1291.

An insertion rib 1294 extending downward along the inner side of the cover edge 1293 may be formed. During the mounting of the harness cover 1290, the insertion rib 1294 may be in contact with the periphery of the perforated opening and may be inserted inside the perforated opening.

A cover hook 1294*a* may be formed on the insertion rib 1294 by protruding outward therefrom and may be held on the periphery of the perforated opening such that the harness cover 1290 is fixedly mounted on the cover plate 250.

Furthermore, a harness outlet part 1295 may be formed on the front half part of the cover body 1292 by protruding outward therefrom. The harness outlet part 1295 may extend in a direction perpendicular to the outer side surface of the cover body 1292, and the harness cover outlet 1296 communicating with the harness receiving space 1291 may be formed in the harness outlet part 1295.

Meanwhile, a harness connector 1731 may be formed on the end part of the wire harness 1730 guided to the upper side of the cover plate 250 by the harness cover 1290. The harness connector 1731 may be configured to be coupled to each of multiple plate connectors 1259 provided on the cover plate 250, and due to the connection of the harness connector 1731 with the plate connector 1259, electronic parts provided in the machine room 201 and the cabinet 100 may be connected to the main control board 1720.

The plate connector 1259 may be mounted on the upper surface of the cover plate 250 and may be exposed to the upper side of the cover plate 250. Additionally, the lower end of the plate connector 1259 may be exposed to the inside of the machine room 201, and the electronic parts may be connected to the plate connector 1259 inside the machine room 201.

For example, the plate connector 1259 connected to the compressor 610 and the heat dissipation fan 611 inside the machine room 201 may be connected to the wire harness 1730, and the display module 800 and the door opening device 900 may be connected to the wire harness through the plate connector 1259. Additionally, the overall operation of these components may be controlled by the control module 1700.

In addition, due to an insulation material filled in the cabinet 100, the wire harness 1730 may be embedded inside the cabinet 100.

Meanwhile, the wire harness 1730 may maintain a state in which a predetermined length of the wire harness 1730 is received inside the harness cover 1290. Additionally, when the receiving casing 1710 is pulled out, the wire harness 1730, which is connected to the receiving casing 1710, may be moved forward together with the receiving casing 1710.

Figure 22:
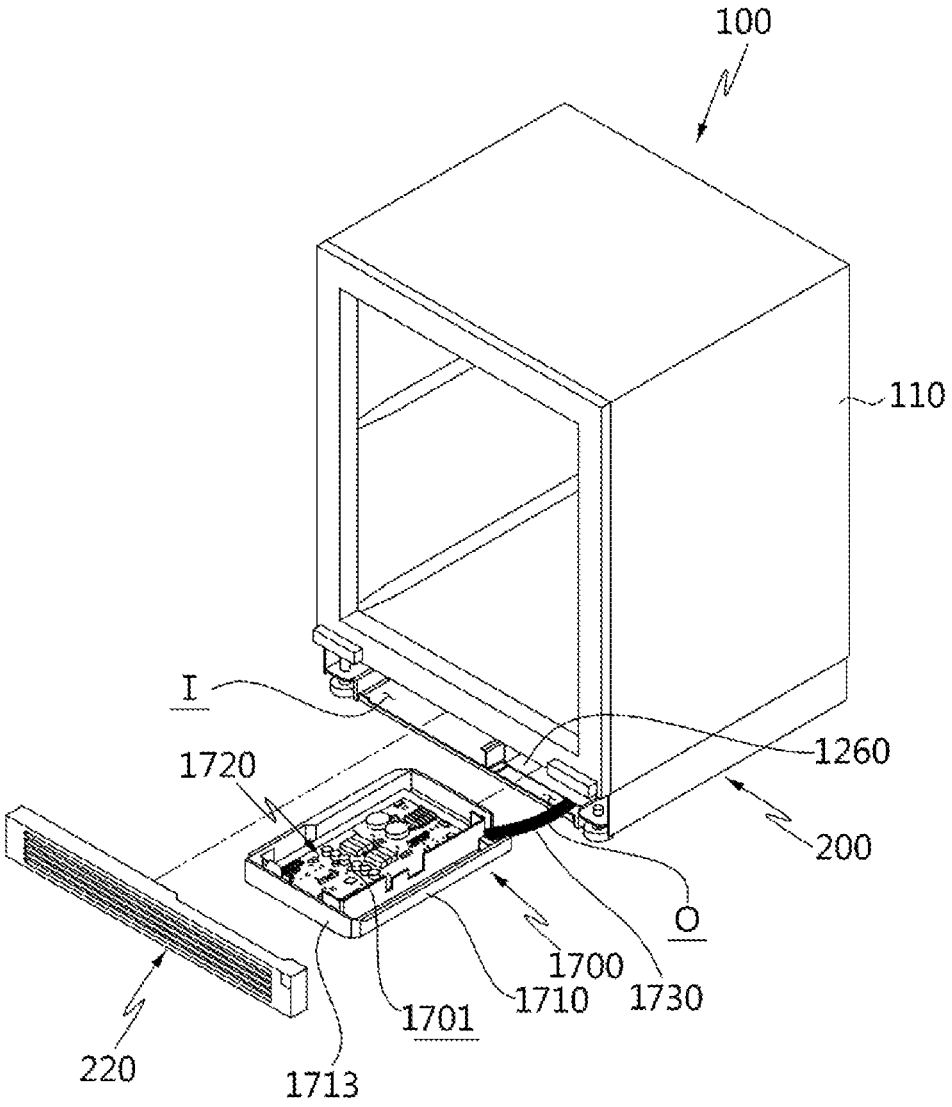
FIG. 22 is an exploded perspective view illustrating the removed state of the control module constituting the refrigerator according to the embodiment illustrated in FIG. 17.

Hereinafter, the maintenance work of the control module 1700 will be described in more detail with reference to the accompanying drawings. FIG. 22 is an exploded perspective view illustrating the removed state of the control module 1700.

As illustrated in the drawing, in a state in which the refrigerator 1 is installed, a user or operator may access the control module 1700. Particularly, even when the refrigerator 1 is embedded in furniture or a wall and only a front surface thereof is exposed to the outside, it is possible to have access to the control module 1700.

Specifically, when the front cover 220 is removed, the front surface of the machine room 201 may be open. Furthermore, the receiving casing 1710 may be exposed to the outside through the open front surface of the machine room 201. A user may forward pull the receiving casing 1710, which is exposed to the outside so as to be moved outside, and in this case, the forward moving out of the receiving casing 1710 may be guided by the casing guide 1260.

In addition, in the process of the pulling out of the receiving casing 1710, the wire harnesses 1730 received inside the harness cover 1290 may also be taken out. Each of the wire harnesses 1730 may be formed to have a length to allow the receiving casing 1710 to be completely pulled to the outside of the machine room 201. Accordingly, while the receiving casing 1710 is pulled out, an operator may perform the repair, update or replacement of the main control board 1720.

After completing the work, the receiving casing 1710 may be inserted back into the casing guide 1260. When the receiving casing 1710 is completely inserted into the casing guide 1260, the wire harness 1730 may be received inside the harness cover 1290.

In the completely inserted state of the receiving casing 1710, an operator may cover the open front surface of the machine room 201 by coupling the front cover 220 to the machine room frame.

The above description is only to illustrate the technical idea of the present disclosure, but those skilled in the art to which the present disclosure pertains will be able to make various modifications and variations without departing from the essential characteristics of the present invention. Accordingly, the embodiments disclosed in the present disclosure is not intended to limit the technical spirit of the present disclosure, but to explain it, and the scope of the technical spirit of the present disclosure is not limited to the embodiments. The scope of protection of the present disclosure should be interpreted by the scope of the claims below, and all technical spirits within the scope equivalent thereto should be interpreted as being included in the scope of the claims of the present disclosure.

The invention claimed is:

1. A refrigerator comprising:

a cabinet having a storage space;

a door assembly configured to open and close at least a portion of the storage space;

a machine room defined below the storage space, the machine room having an inlet and an outlet that are defined at a front surface thereof;

a cooling system disposed in the machine room, the cooling system comprising a compressor, a condenser, and a heat dissipation fan; and a control module that is disposed inside the machine room and faces the outlet, wherein the control module comprises:

a receiving casing that is coupled to an upper part of the machine room, the receiving casing defining a receiving space in a center thereof, and a main control board disposed in the receiving space and connected to an external part by one or more wires.

2. The refrigerator of claim 1, further comprising a front cover that defines the inlet and the outlet and is disposed at the front surface of the machine room, wherein the control module faces the front cover.

3. The refrigerator of claim 1, further comprising a cover plate disposed at the upper part of the machine room, wherein the control module is mounted to a lower surface of the cover plate and spaced apart from a bottom surface of the machine room.

4. The refrigerator of claim 1, further comprising an installation rail that is disposed at the upper part of the machine room and extends parallel to the outlet, wherein the control module is coupled to the installation rail and configured to move in and out of the outlet along the installation rail.

5. The refrigerator of claim 3, wherein the control module is disposed parallel to the lower surface of the cover plate.

6. The refrigerator of claim 1, wherein a vertical height of the control module is less than an overall height of the machine room, and wherein a lower surface of the control module is spaced apart from a bottom surface of the machine room to thereby define a discharge space between the lower surface of the control module and the bottom surface of the machine room.

7. The refrigerator of claim 1, wherein an area of the inlet is larger than an area of the outlet.

8. The refrigerator of claim 1, further comprising an installation rail that is disposed at the upper part of the machine room, wherein the control module further comprises a guide end that protrudes from sides of the receiving casing and faces the installation rail.

9. The refrigerator of claim 1, further comprising a cover plate disposed at the upper part of the machine room, wherein the receiving casing is opened toward a lower surface of the cover plate.

10. The refrigerator of claim 1, wherein the control module defines a wire connection space outside the receiving space, the wire connection space surrounding at least a portion of the receiving space, and wherein the control module further comprises a partition wall disposed between the receiving space and the wire connection space.

11. The refrigerator of claim 1, further comprising a cover plate disposed at the upper part of the machine room, wherein the control module further comprises:

a casing guide mounted to the cover plate and configured to guide movement of the receiving casing in and out of the outlet.

12. The refrigerator of claim 1, further comprising a separation wall that is disposed in the machine room and divides the machine room into (i) an introduction space that receives the condenser and (ii) a discharge space that receives the compressor and the control module, wherein the control module is mounted on an upper surface of the machine room and spaced apart from a bottom surface of the machine room.

13. The refrigerator of claim 12, wherein the separation wall comprises:

a first wall that extends rearward from the front surface of the machine room and is perpendicular to the front surface of the machine room; and a second wall that extends from a rear end of the first wall and is inclined with respect to the first wall such that a width of the introduction space decreases rearward from the rear end of the first wall, and wherein the control module is disposed along the first wall.

14. The refrigerator of claim 1, wherein the cabinet comprises:

an outer casing that defines an external surface of the cabinet;

an inner casing that is spaced part from the outer casing to thereby define an insulation space between the inner casing and the outer casing; and a foam insulation material provided in the insulation space, wherein the refrigerator further comprises a cover plate that defines a lower surface of the outer casing, and wherein the control module is mounted to a lower surface of the cover plate.

15. The refrigerator of claim 14, wherein the cover plate defines an opening, wherein the refrigerator further comprises a harness cover mounted to the opening of the cover plate, and wherein the control module comprises a wire harness guided through the harness cover to a position above the machine room.

16. The refrigerator of claim 15, wherein the receiving casing is disposed in the machine room and configured to move along a movement direction through the outlet, and wherein the harness cover defines a harness receiving space that is recessed from a surface of the harness cover and extends in the movement direction of the receiving casing, the harness receiving space being configured to accommodate the wire harness based on the receiving casing moving along the movement direction.

17. The refrigerator of claim 11, wherein the receiving casing is opened upward and has an inner edge extending upward from a bottom surface of the receiving casing, the inner edge extending along a periphery of the main control board to thereby define a space to receive the main control board, wherein the receiving casing further defines a space between the inner edge and a peripheral surface of the receiving casing, and wherein the control module further comprises a wire harness that is guided through the space defined between the inner edge and the peripheral surface of the receiving casing.

18. The refrigerator of claim 11, wherein the casing guide comprises:

a lower surface part that supports a lower surface of the receiving casing;

a side surface part that extends upward from ends of the lower surface part and is fixed to the cover plate; and a rear surface part that extends upward from a rear end of the lower surface part and is configured to limit an inward movement of the receiving casing.

19. The refrigerator of claim 1, wherein the condenser faces the inlet, and each of the compressor and the heat dissipation fan is disposed at a rear portion of the machine room, wherein the refrigerator further comprises a cover plate disposed at the upper part of the machine room, the cover plate comprising:

a first cover part disposed above the condenser; and a second cover part disposed above the compressor and the heat dissipation fan, and wherein the first cover part and the second cover part have heights different from each other.

20. A refrigerator comprising:

a cabinet having a storage space;

a door assembly configured to open and close at least a portion of the storage space;

a machine room defined below the storage space, the machine room having an inlet and an outlet that are defined at a front surface thereof;

a cooling system disposed in the machine room, the cooling system comprising a compressor, a condenser, and a heat dissipation fan;

a control module that is disposed inside the machine room and faces the outlet; and a separation wall that is disposed in the machine room and divides the machine room into (i) an introduction space that receives the condenser and (ii) a discharge space that receives the compressor and the control module, wherein the control module is mounted on an upper surface of the machine room and spaced apart from a bottom surface of the machine room.

* * * * *